US007661674B2

(12) United States Patent
Izuchi et al.

(10) Patent No.: US 7,661,674 B2
(45) Date of Patent: Feb. 16, 2010

(54) FEEDING DEVICE AND IMAGE RECORDING APPARATUS EQUIPPED WITH THE FEEDING DEVICE

(75) Inventors: Masatoshi Izuchi, Nagoya (JP); Noritsugu Ito, Tokoname (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 373 days.

(21) Appl. No.: 11/275,700

(22) Filed: Jan. 25, 2006

(65) Prior Publication Data

US 2006/0163803 A1 Jul. 27, 2006

(30) Foreign Application Priority Data

Jan. 26, 2005 (JP) ..... 2005-018127

(51) Int. Cl.
*B65H 27/00* (2006.01)

(52) U.S. Cl. ..... 271/274; 271/188; 271/272; 271/273

(58) Field of Classification Search ..... 271/274, 271/188, 272, 273
See application file for complete search history.

(56) References Cited

U.S. PATENT DOCUMENTS 3,484,099 A * 12/1969 Gallagher ..... 271/274
4,195,832 A * 4/1980 Krumrey ..... 271/274
4,359,217 A 11/1982 Roller et al.
4,420,151 A * 12/1983 Kobayashi ..... 271/263
5,094,660 A * 3/1992 Okuzawa ..... 493/320
5,152,522 A 10/1992 Yamashita
5,265,864 A 11/1993 Roux et al.
5,537,193 A * 7/1996 Hasegawa et al. ..... 399/398

(Continued)

FOREIGN PATENT DOCUMENTS

JP 59114243 A * 7/1984

(Continued)

OTHER PUBLICATIONS

U.S. Patent and Trademark Office, Office Action in co-pending U.S. Appl. No. 11/317,205, mailed Dec. 26, 2008.

(Continued)

*Primary Examiner*—Patrick H Mackey
*Assistant Examiner*—Howard Sanders
(74) *Attorney, Agent, or Firm*—Baker Botts, LLP.

(57) ABSTRACT

A feeding device including a drive roller and a driven roller opposed to the drive roller and biased toward the drive roller, such that the drive and driven rollers cooperate to feed a sheet while holding the sheet therebetween. The driven roller includes a toothed wheel portion and a contactable portion having a diameter smaller than that of the toothed wheel portion. The drive roller includes first and second portions. A radially outer end of the second portion is more distant from an axis of the drive roller than a radially outer end of the first portion. During absence of the sheet between the drive and driven rollers, the contactable portion of the driven roller is held in contact at its circumferential surface with a circumferential surface of the second portion of the drive roller, while a radially outer end of the toothed wheel portion is not in contact with a circumferential surface of the first portion. Also disclosed is an image recording apparatus including the above-described feeding device.

21 Claims, 18 Drawing Sheets

U.S. PATENT DOCUMENTS

| | | | | | |
|---|---|---|---|---|---|
| 5,606,357 | A | * | 2/1997 | Bekki | 347/104 |
| 5,653,439 | A | * | 8/1997 | Rider et al. | 271/274 |
| 5,820,122 | A | * | 10/1998 | Schneider | 271/188 |
| 5,961,234 | A | * | 10/1999 | Uchikata | 400/636 |
| 6,089,567 | A | * | 7/2000 | Yatsuhashi et al. | 271/314 |
| 6,293,669 | B1 | * | 9/2001 | Uchida | 347/104 |
| 6,619,658 | B2 | | 9/2003 | Shiau | |
| 6,804,932 | B2 | * | 10/2004 | Joyce et al. | 53/377.6 |
| 6,962,333 | B2 | * | 11/2005 | Mizuno et al. | 271/109 |
| 7,090,419 | B2 | * | 8/2006 | Satoh et al. | 400/641 |
| 7,264,239 | B2 | | 9/2007 | Kawai | |
| 7,401,780 | B2 | * | 7/2008 | Carter et al. | 271/272 |
| 2002/0145656 | A1 | * | 10/2002 | Lin et al. | 347/104 |
| 2003/0016401 | A1 | * | 1/2003 | Saito | 358/498 |
| 2003/0230847 | A1 | * | 12/2003 | Shikahama et al. | 271/264 |
| 2004/0190972 | A1 | * | 9/2004 | Kawai | 400/636 |
| 2005/0068401 | A1 | * | 3/2005 | Aoki | 347/104 |
| 2006/0082052 | A1 | * | 4/2006 | Noda | 271/314 |
| 2006/0139430 | A1 | | 6/2006 | Izuchi et al. | |

FOREIGN PATENT DOCUMENTS

| | | | | |
|---|---|---|---|---|
| JP | S60-105652 | U | | 7/1985 |
| JP | 61033455 | A | * | 2/1986 |
| JP | 61166454 | A | * | 7/1986 |
| JP | H03-023151 | U | | 3/1991 |
| JP | H07-068870 | A | | 3/1995 |
| JP | H07-277578 | A | | 10/1995 |
| JP | 09086749 | A | * | 3/1997 |
| JP | H09-086749 | A | | 3/1997 |
| JP | H10 167507 | | | 6/1998 |
| JP | 2000-327169 | A | | 11/2000 |
| JP | 2001-080805 | A | | 3/2001 |
| JP | 2005314040 | A | * | 11/2005 |

OTHER PUBLICATIONS

Japan Patent Office, Notification of Reason for Refusal for counterpart Patent Application No. JP 2005-018127, mailed Sep. 24, 2008.

* cited by examiner

FIG.9

| | W=0.7mm | | | W=1mm | | | W=1.3mm | | | W=1.7mm | | |
|---|---|---|---|---|---|---|---|---|---|---|---|---|
| DEFLECTION T(mm) | C=0.6mm | C=1mm | C=1.4mm | C=0.6mm | C=1mm | C=1.4mm | C=0.6mm | C=1mm | C=1.4mm | C=0.6mm | C=1mm | C=1.4mm |
| 0.1 | 23 | 6.6 | 2.8 | 16 | 5.1 | 2.3 | 13.1 | 4.5 | 1.9 | 10.5 | 3.8 | 1.7 |
| 0.2 | 44 | 12.8 | 5.4 | 30 | 9.6 | 4.4 | 29.2 | 8.8 | 3.7 | 23 | 7.4 | 3.3 |
| 0.3 | 66 | 19 | 7.9 | 44 | 14.2 | 6.6 | 43.4 | 12.3 | 5.4 | 35 | 10.8 | 4.9 |

| W=2mm | | | W=2.7mm | | | W=4.7mm | | |
|---|---|---|---|---|---|---|---|---|
| C=0.6mm | C=1mm | C=1.4mm | C=0.6mm | C=1mm | C=1.4mm | C=0.6mm | C=1mm | C=1.4mm |
| 9.9 | 3.2 | 1.5 | 8 | 2.6 | 1.2 | 6 | 1.6 | 0.8 |
| 19.6 | 6.1 | 2.9 | 15 | 5 | 2.3 | 9 | 3.1 | 1.5 |
| 29 | 9.1 | 4.3 | 21 | 7.4 | 3.5 | 13 | 4.5 | 2.2 |

FEEDING DEVICE AND IMAGE RECORDING APPARATUS EQUIPPED WITH THE FEEDING DEVICE

This application is based on Japanese Patent Application No. 2005-018127 filed in Jan. 26, 2005, the content of which is incorporated hereinto by reference.

BACKGROUND OF THE INVENTION

1. Field of the Invention

The present invention relates in general to a feeding device including: a drive roller that is driven by a drive source; and a driven roller that is opposed to the drive roller in its radial direction and is biased toward the drive roller, so that the drive and driven rollers cooperate with each other to feed a sheet in a feeding direction while holding the sheet therebetween. The invention also relates to an image recording apparatus equipped with such a feeding device.

2. Discussion of Related Art

A feeding device for feeding a sheet is conventionally employed in an image recording apparatus of an inkjet type such as a printer, a facsimile machine or the like. In the sheet feeding device, it is desirable to feed the sheet without deteriorating the quality of images recorded on a surface of the sheet such as a recording medium to be fed. An ordinary structure of the feeding device used on the image recording apparatus is disclosed in U.S. Pat. No. 5,961,234 (corresponding to JP-H10-167507A), for instance. Described specifically, in the disclosed feeding device, there are disposed a metallic drive roller driven by a drive source and a driven roller opposed to the drive roller in a sheet feed path through which the sheet is to be fed. The driven roller includes a plurality of rowels arranged to be opposed to a circumferential surface of the drive roller, so that the sheet can be fed, while being held by and between the drive roller and the plurality of rowels of the driven roller, with the rowels being brought into contact with a recorded surface of the sheet on which an image has been recorded. The plurality of rowels are arranged to be opposed to respective annular grooves formed in the drive roller. The drive and driven rollers are positioned relative to each other such that the rowels are received in the respective annular grooves without a toothed radially outer end portion of each rowel being brought into contact with a bottom surface of the corresponding annular groove.

In the disclosed feeding device, the driven roller including the plurality of rowels is biased by a spring, toward the drive roller, so that the sheet can be held between the drive and driven rollers during presence of the sheet therebetween. Further, with a width (axial length) of each of the annular grooves is adapted to be smaller than 10 mm, each of the rowels is displaced by a tension force of the sheet (held between the drive and driven rollers), radially outwardly toward outside the corresponding annular groove, against a biasing force generated by the spring. It is therefore possible to reduce an amount of deflection of the sheet, thereby enabling the sheet to be held in close contact with the circumferential surface of the drive roller. Still further, with the width of each of the annular grooves being adapted to be not smaller than 10 mm, the toothed radially outer end portion of each rowel is kept to be partially received in the corresponding annular groove, although each rowel is displaced by the tension force of the sheet radially outwardly toward outside the corresponding annular groove against the biasing force of the spring. Thus, a certain degree of the tension force is given to the sheet.

However, in the above-describe construction of the disclosed feeding device, during absence of the sheet between the drive and driven rollers, if each rowel is deeply received in the corresponding annular groove without its toothed radially outer end portion being in contact with any part of the annular groove, namely, if the toothed radially outer end portion of each rowel overlaps with the drive roller by a large amount, a leading end of the paper sheet, upon its entrance between the drive and driven rollers, is brought into contact with a portion of each rowel that is closed to an axis of the rowel, so that each rowel can not be smoothly rotated. Thus, the entrance of the sheet between the drive and driven rollers is made difficult, causing a risk of jamming of the sheet.

Further, upon entrance of the sheet between the drive and driven rollers, for obtaining a space available for the sheet feed path the leading end of the sheet has to force each rowel of the driven roller to be raised against the biasing force of the spring, such that each rowel is displaced outside the circumferential surface of the drive roller in the radial direction. In this instance, the biasing force of the spring acts as a force which resists the upward displacement of each rowel and increases a resistance acting against feed motion of the sheet upon entrance of the sheet between the drive and driven rollers. Such an increase in the resistance during the feed motion of the sheet is likely to cause undesirable variation in a distance by which the sheet is fed per each of the successive feed motions, causing a so-called "banding" (i.e., formation of extraneous lines in the image recorded on the sheet) and the consequent deterioration in the recording or printing quality.

SUMMARY OF THE INVENTION

The present invention was made in view of the background prior art discussed above. It is therefore a first object of the present invention to provide a feeding device which is capable of feeding a sheet with a high accuracy, without suffering deterioration in the printing quality, which could be caused in even of occurrence of the above-described "banding". A second object of the invention is to provide an image recording apparatus including such a feeding device capable of highly accurately feeding a sheet. The first object may be achieved according to any one of first through sixth aspects of the invention which are described below. The second object may be achieved according to a seventh aspect of the invention which is described below.

The first aspect of the invention provides a feeding device for feeding a sheet in a feeding direction, including: (a) a drive roller that is be driven by a drive source; and (b) a driven roller that is opposed to the drive roller in a radial direction thereof and is biased toward the drive roller, such that the driven roller and the drive roller cooperate with each other to feed the sheet while holding the sheet therebetween. The driven roller includes a toothed wheel portion and a contactable portion having a diameter smaller than that of the toothed wheel portion. The drive roller includes a first portion and a second portion, such that a radially outer end of the second portion is more distant from an axis of the drive roller than a radially outer end of the first portion. The toothed wheel portion and the contactable portion of the driven roller are opposed to the first portion and the second portion of the drive roller, respectively, in the radial direction. The drive and driven rollers are positioned relative to each other during absence of the sheet therebetween, such that the contactable portion of the driven roller is held in contact at a circumferential surface thereof with a circumferential surface of the second portion of the drive roller, and such that a radially outer end of the toothed wheel portion is not in contact with a circumferential surface of the first portion.

According to the second aspect of the invention, in the feeding device defined in the first aspect of the invention, a biaser is provided to bias the driven roller toward the drive roller.

According to the third aspect of the invention, in the feeding device defined in the first or second aspect of the invention, the toothed wheel portion of the driven roller is arranged substantially symmetrically with respect to a center of the driven roller in an axial direction of the driven roller, wherein the contactable portion of the driven roller is arranged substantially symmetrically with respect to the center of the driven roller in the axial direction of the driven roller.

According to the fourth aspect of the invention, in the feeding device defined in any one of the first through third aspects of the invention, the toothed wheel portion of the driven roller is provided by two rowels that are spaced apart from each other in an axial direction of the driven roller, while the contactable portion of the driven roller is provided by an intermediate hub portion that is located between the two rowels in the axial direction of the driven roller, wherein the first portion of the drive roller is provided by two annularly grooved portions that are spaced apart from each other in an axial direction of the drive roller, while the second portion of the drive roller is provided by a non-grooved portion that is located between the two annularly grooved portions in the axial direction of the drive roller, such that each of the two rowels is received at least at a peripheral portion thereof in a corresponding one of the two annularly grooved portions during absence of the sheet between the drive and driven rollers, and such that the intermediate hub portion is held in contact with the non-grooved portion during absence of the sheet between the drive and driven rollers.

According to the fifth aspect of the invention, in the feeding device defined in any one of the first through third aspects of the invention, the contactable portion of the driven roller is provided by two outside hub portions that are spaced apart from each other in an axial direction of the driven rollers while the toothed wheel portion of the driven roller is provided by at least one rowel that is located between the two outside hub portions in the axial direction of the driven roller, wherein the second portion of the drive roller is provided by two non-grooved portions that are spaced apart from each other in an axial direction of the drive roller, while the first portion of the drive roller is provided by an annularly grooved portion that is located between the two non-grooved portions, such that each of the at least one rowel is received at least at a peripheral portion thereof in the annularly grooved portion during absence of the sheet between the drive and driven rollers, and such that the two outside hub portions are held in contact with the two non-grooved portions during absence of the sheet between the drive and driven rollers.

According to the sixth aspect of the invention, in the feeding device defined in any one of the first through fifth aspects of the invention, a biaser is provided to bias the driven roller toward the drive roller, wherein the drive roller has one of an annular protrusion and an annular recess, while the driven roller has the other of the annular protrusion and the annular recess, such that at least a part of the annular protrusion is received in the annular recess during absence of the sheet between the drive and driven rollers, wherein the drive and driven rollers have a pair of inclined surfaces each of which is provided by at least a part of one of circumferential surfaces of the respective annular protrusion and recess, and wherein the inclined surfaces are inclined with respect to the axis of the drive roller, in respective opposite directions by substantially the same degree, such that the inclined surfaces cooperate with each other to have a radially convexed shape that is convexed in a direction away from the annular protrusion toward the annular recess, namely, such that the inclined surfaces cooperate with each other to generate forces which are based on a biasing force generated by the biaser and which act in the driven roller in respective directions parallel to the axis of the drive roller. It is noted that the pair of inclined surfaces may be provided by one of the annular protrusion and recess, or alternatively, the pair of inclined surfaces may be arranged such that one of the pair of inclined surfaces is provide by one of the annular protrusion and recess while the other of the pair of inclined surfaces is provided by the other of the annular protrusion and recess.

The seventh aspect of the invention provides an image recording apparatus including: the feeding device defined in defined in any one of the first through sixth aspects of the invention; and an image recording unit which is operable to record an image on the sheet, wherein the feeding device is disposed on a downstream side of the image recording unit as viewed in the feeding direction, so as to feed the sheet having the image recorded thereon.

In the feeding device defined in any one of the first through sixth aspects of the invention, the radially outer end of the toothed wheel portion of the driven roller is not contact with the drive roller even during absence of the sheet between the drive and driven rollers. Therefore, where the toothed wheel portion is provided by at least one rowel each having sharp projections as the radially outer end, it is possible to minimize an amount of wear of the sharp projections of each rowel, thereby leading to improvement in durability of the driven roller. Further, during absence of the sheet between the drive and driven rollers, the contactable portion of the driven roller is held in contact at its outer circumferential surface with the outer circumferential surface of the second portion of the drive roller, the driven roller is raised or forced in a direction opposite to a direction in which the driven roller is biased toward the drive roller, thereby making it possible to reduce an overlap amount by which the toothed wheel portion of the driven roller overlaps with the second portion of the drive roller in the radial direction. The reduction in the overlap amount leads to a reduction in an amount by which the driven roller has to be raised or displaced away from the drive roller, upon entrance of a leading end of the sheet between the drive and driven rollers. That is, it is possible to reduce a resistance acting against feed motion of the sheet upon entrance of the leading end of the sheet between the drive and driven rollers. Therefore, the sheet can be fed accurately, without suffering the above-described "banding" and other deterioration in the recording or printing quality.

In the feeding device defined in the sixth aspect of the invention, the drive and driven rollers have the pair of inclined surfaces each provided by at least a part of one of the circumferential surfaces of the respective annular protrusion and recess that are engaged to each other during absence of the sheet between the drive and driven rollers. The inclined surfaces are inclined, with respect to the axis of the drive or driven roller, in respective opposite directions by substantially the same degree, such that the inclined surfaces cooperate with each other to have the radially convexed shape that is convexed in the direction away from the annular protrusion toward the annular recess. In this arrangement, when a trailing end of the sheet is removed from between the drive and driven rollers, namely, when the annular protrusion and the annular recess are brought into contact at their circumferential surfaces with each other, the inclined surfaces cooperate with each other to generate forces which are based on the biasing force generated by the biaser and which act the driven roller in the respective opposite directions parallel to the axis of the drive or driven roller. Therefore, it is possible to maintain a predetermined positional relationship between the annular protrusion and the annular recess, i.e., between the drive roller and the driven roller in the axial direction.

Where the sixth aspect of the invention is carried out in combination with the fourth aspect of the invention, the annular protrusion is defined by each of the non-grooved portion located between the two annularly grooved portions, while the annular recess is defined by the intermediate hub portion located between the two rowels. In this case, it is possible to assure a predetermined clearance or distance by which each of the two rowels received in a corresponding one of the two annularly grooved portions is distant from the non-grooved portion in the axial direction, thereby preventing collision of the sharp projections of the radially outer end of each rowel against the circumferential surface of the non-grooved portion and according avoiding breakage of the sharp projections of the radially outer end of each rowel. Further, the two clearances (i.e., the clearance between one of the two rowels and a corresponding one of axially opposite ends of the non-grooved portion, and the clearance between the other of two rowels and the other of the axially opposite ends of the non-grooved portion) can be held substantially equal to each other, thereby assuring an even distribution of feeding force applied to the sheet in its width direction, and accordingly preventing an feed movement of the sheet in a direction that is inclined with respect to the predetermined feeding direction.

Where the sixth aspect of the invention is carried out in combination with the fifth aspect of the invention, the annular protrusion is defined by the at least one rowel and the adjacent portions of the respective two outside hub portions, while the annular recess is defined by the annularly grooved portion between the two non-grooved portions. In this case, too, the feeding device has the above-described technical advantages as where the sixth aspect of the invention is carried out in combination with the fourth aspect of the invention.

In the image recording apparatus which is defined in the seventh aspect of the invention and includes the feeding device defined in defined in any one of the first through sixth aspects of the invention, it is possible to obtain the above-described advantages provided by the feeding device. The image recording apparatus according to the invention is advantageous in particular where an image with high dot density such as photographic image is recorded on the sheet. In such as cease of recording of an image with high dot density on the sheet, the sheet is likely to get wet due to the ink attached thereto with high density, and to suffer from low resiliency (namely, a low resistance force to the deflection, or a restoring force for restoring its original shape from the deflection), leading to a reduction in the sheet feeding force. The reduction in the sheet feeding force may undesirably cause shortage of a sheet feed amount per each of the successive feed motions, and accordingly may result in occurrence of the banding. The present image recording apparatus, however, is free from a considerable reduction in capacity of feeding the sheet held between the drive and driven rollers, assuring reliable feeding of the sheet in the feeding direction, whereby the occurrence of the banding can be avoided.

BRIEF DESCRIPTION OF THE DRAWINGS

The above and other objects, features, advantages and technical and industrial significance of the present invention will be better understood by reading the following detailed description of presently preferred embodiment of the invention, when considered in connection with the accompanying drawings, in which:

FIG. 9 is a table showing data of experimental results;

DETAILED DESCRIPTION OF THE PREFERRED EMBODIMENTS

Figure 1:
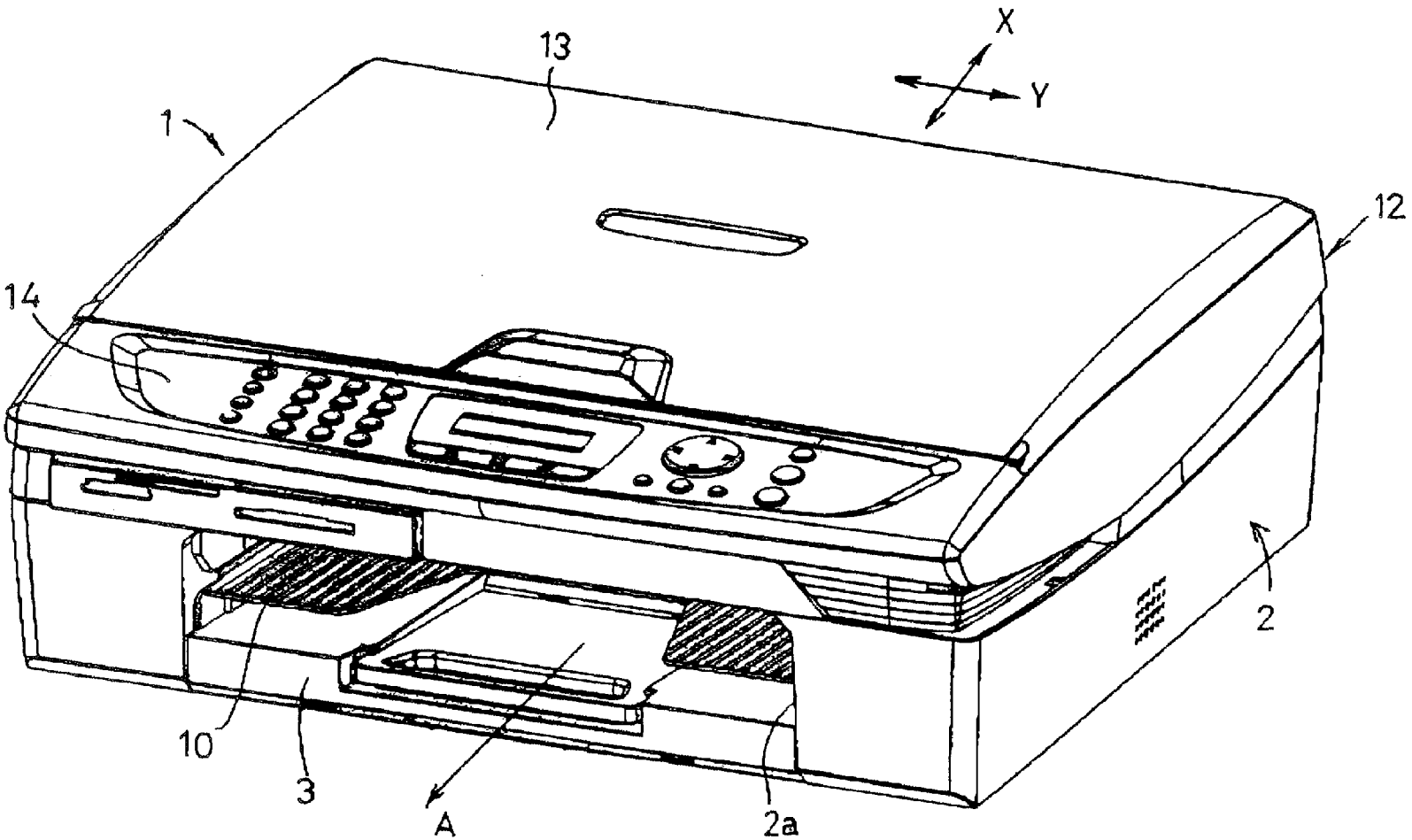
FIG. 1 is a perspective view showing an inkjet type image recording apparatus equipped with a feeding device to which the principle of the invention is applied.
Figure 2:
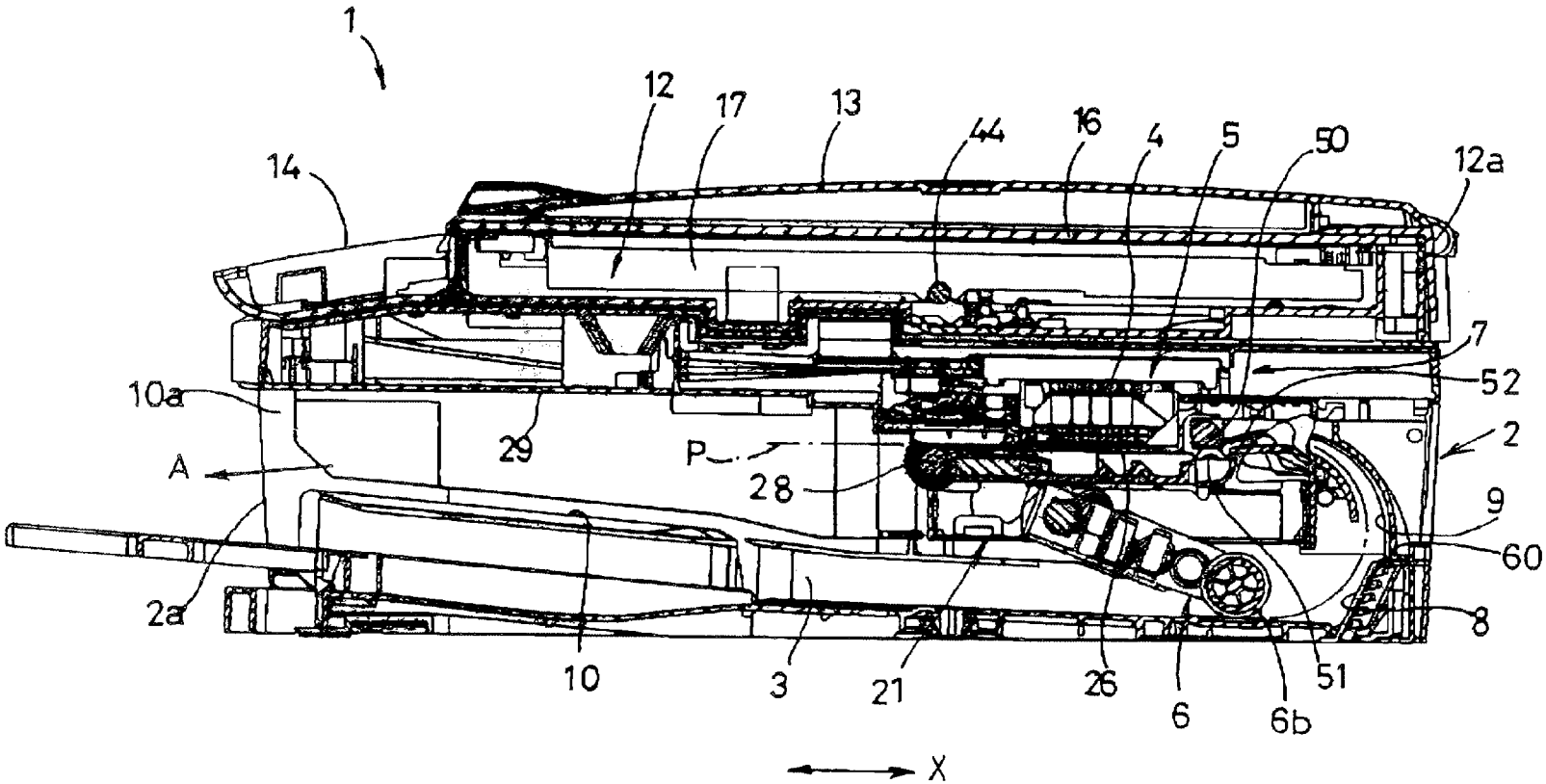
FIG. 2 is a side elevational view in cross section showing the apparatus of FIG. 1.

FIGS. 1 and 2 show an image recording apparatus 1 in the form of a multi function device (MFD) which has a printing function, a copying function, a scanning function and a facsimile function. As shown in FIGS. 1 and 2, the image recording apparatus 1 has a housing 2 as a main body of the apparatus 1. The housing 2 is formed, by injection, of a synthetic resin.

On an upper portion of the housing 2, there is disposed an image reading device 12 operable to achieving the copying and facsimile functions of the apparatus 1. The image reading device 12 is arranged to be pivotable upwardly and downwardly about one end of the housing 2 via a hinge (not shown). An original (manuscript) covering member 13 covering an upper surface of the image reading device 12 is pivotally connected at its rear end to a rear end of the image reading device 12 through a pivot shaft 12*a* such that the original covering member 13 is pivotable upwardly and downwardly about the pivot shaft 12*a*.

Further, on the upper portion of the housing 2, there is provided an operator's control panel 14 located on a front side of the image reading device 12 and having various control buttons and keys, a liquid crystal display, etc. On the upper surface of the image reading device 12, there is provided a glass plate 16 on which an original or manuscript is to be placed when the original covering member 13 is opened. Below the grass plate 16, an image scanning device (CIS: Contact Image Sensor) 17 for reading the image on the original is provided so as to be reciprocably movable along a guide rod 44 that extends in a direction perpendicular to a sheet plane of FIG. 2 (i.e., a main scanning direction, that is, in a Y-axis direction indicated in FIG. 1).

In an ink storage portion (not shown), there are stored four ink cartridges accommodating inks of four different colors, e.g., black (Bk), cyan (C), magenta (M) and yellow (Y). The ink cartridges are connected to a recording head 4 of a recording portion (an image recording unit) 7 through respective flexible ink supply tubes.

As shown in FIGS. 1 and 2, there is disposed, on a lower or bottom portion of the housing 2, a sheet supply cassette 3 that can be inserted through a front opening 2*a* located on the front side of the housing 2 (i.e., on the left side in FIG. 2). The sheet supply cassette 3 is arranged to accommodate sheets to be fed in the form of a stack of cut sheets P of a selected size such as an A4 size, a letter size, a legal size or a postcard size, such that the width direction of each cut sheet P parallel to its two parallel short sides is held in parallel to a direction (i.e., the direction perpendicular to the sheet plane of FIG. 2, the main scanning direction, or the Y-axis direction) perpendicular to a sheet feeding direction in which the sheets are fed (i.e., a sub-scanning direction, an X-axis direction or a direction indicated by an arrow X shown in FIGS. 1 and 2). The sheet feeding direction is indicated by an arrow "A" in FIGS. 1, 3 and 5.

Figure 4:
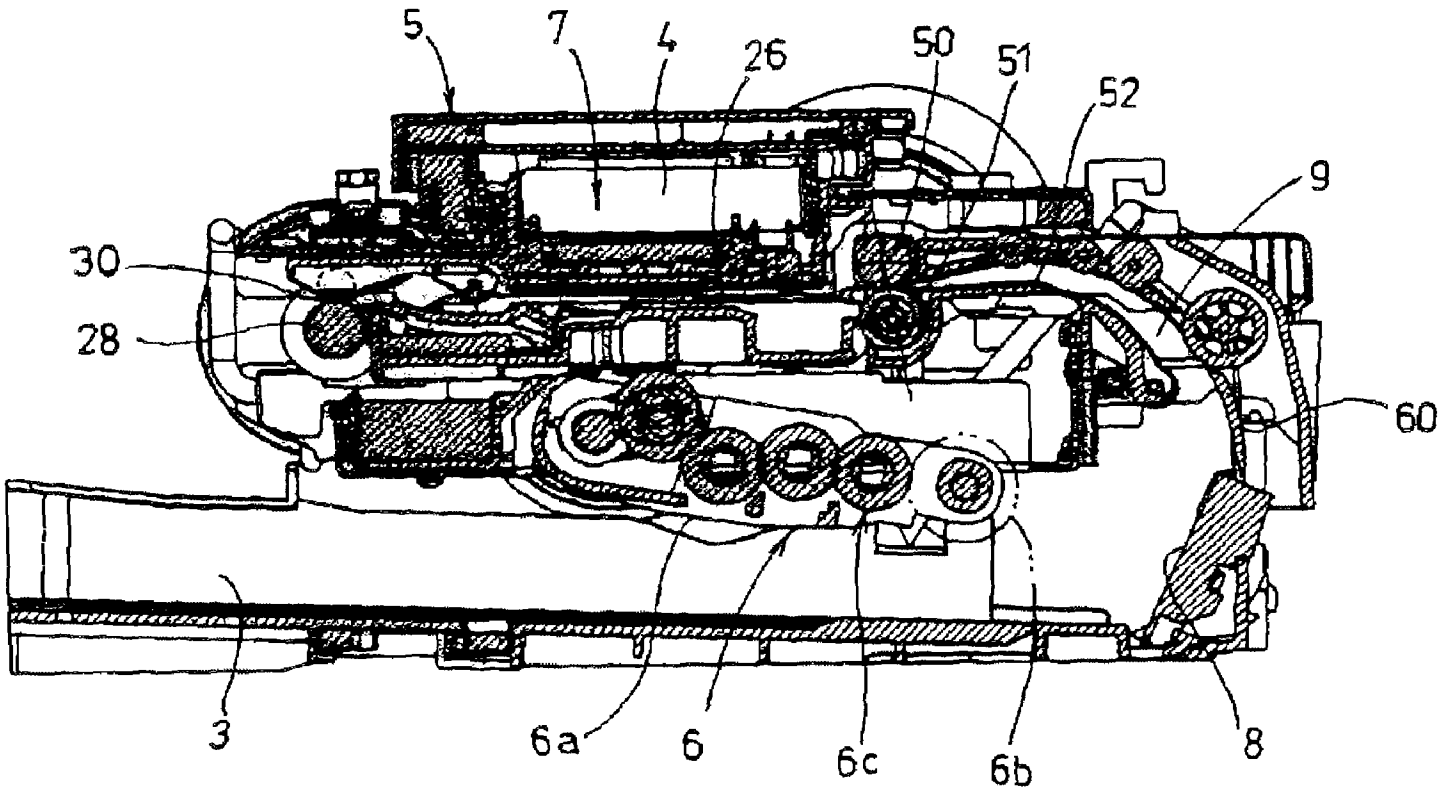
FIG. 4 is a cross sectional view taken along line 4-4 of FIG. 3.

At one of opposite ends of the sheet-supply cassette 3 remote from the front opening 2*a* of the housing 2 (i.e., on the right side in FIG. 2), there is disposed a slant sheet separator plate 8. Further, as shown in FIG. 4, a roller support arm 6*a* of a sheet supplying device 6 is supported at its proximal end (upper end) by the housing 2 such that the roller support arm 6*a* is pivotable upwardly and downwardly. The roller support arm 6*a* carries at its distal end portion (lower end portion) a sheet separate roller 6*b* to which a rotary motion from a drive source (not shown) is transmitted through a gear transmission mechanism 6*c* disposed in the roller support arm 6*a*. The sheet separate roller 6*b* and the slant sheet separator plate 8 cooperate with each other to separate the uppermost sheet P from the stack accommodated in the sheet supply cassette 3 and feed the separated sheet P toward the recording portion 7 located above the sheet supply cassette 3, via a sheet supply path 9 including a U-turn path portion. The sheet supply path 9 is given by a space that is defined between a first supply-path-defining member 60 located on an outside of the U-turn path portion of the sheet-supply path 9 and a second supply-path defining member 52 located on an inside of the U-turn path portion of the same 9. Each sheet P is arranged to be fed through the sheet-supply path 9 such that a centerline of the sheet P in its widthwise direction is aligned with a centerline of the sheet-supply path 9 in its widthwise direction perpendicular to the sheet feeding direction A.

As shown in FIGS. 2-5, the recording portion 7 is supported by a main frame 21 of box structure which includes a pair of side plates 21*a*, 21*a*, and is disposed between a first guide member 22 and a second guide member 23 each in the form of an elongated plate. The first and second guide members 22, 23 are supported by the side plates 21*a* and extend in the Y-axis direction (the main scanning direction). A carriage 5 which carries the ink-jet recording head 4 of the recording portion 7 is mounted on the first guide member 22 (located on an upstream side of the carriage 6 in the sheet feeding direction A) and the second guide member 23 (located on a downstream side of the carriage 5 in the sheet feeding direction A), so as to bridge these two guide members 22, 23, such that the carriage 5 is slidably movable on the guide members 22, 23. Thus, the carriage 5 is reciprocably movable in the Y-axis direction.

For reciprocably moving the carriage 5, there is disposed, on an upper surface of the second guide member 23, a timing belt 24 which extends in the main scanning direction (the Y-axis direction). Further, a carriage drive motor (not shown) operable to reciprocate the carriage 5 through the timing belt 24 is fixed to a lower surface of the second guide member 23.

Figure 3:
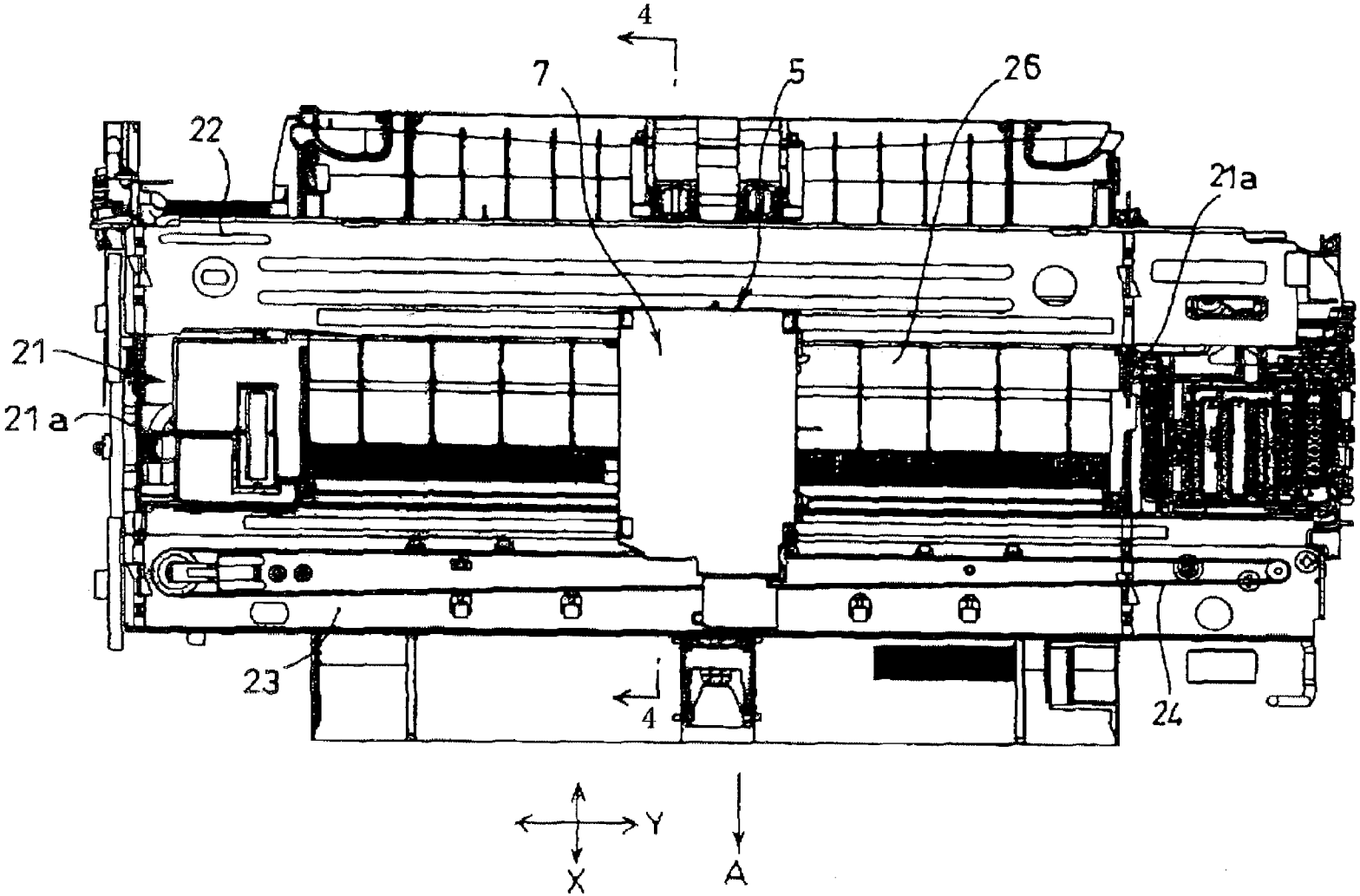
FIG. 3 is a plan view of the apparatus of FIG. 1 from which an image reading device is removed.

As shown in FIG. 3, a platen 26 having a flattened shape is fixed to the main frame 21 between the first and second guide members 22, 23. The platen 26 extends in the Y-axis direction so as to face an underside of the recording head 4 carried by the carriage 5.

Figure 5:
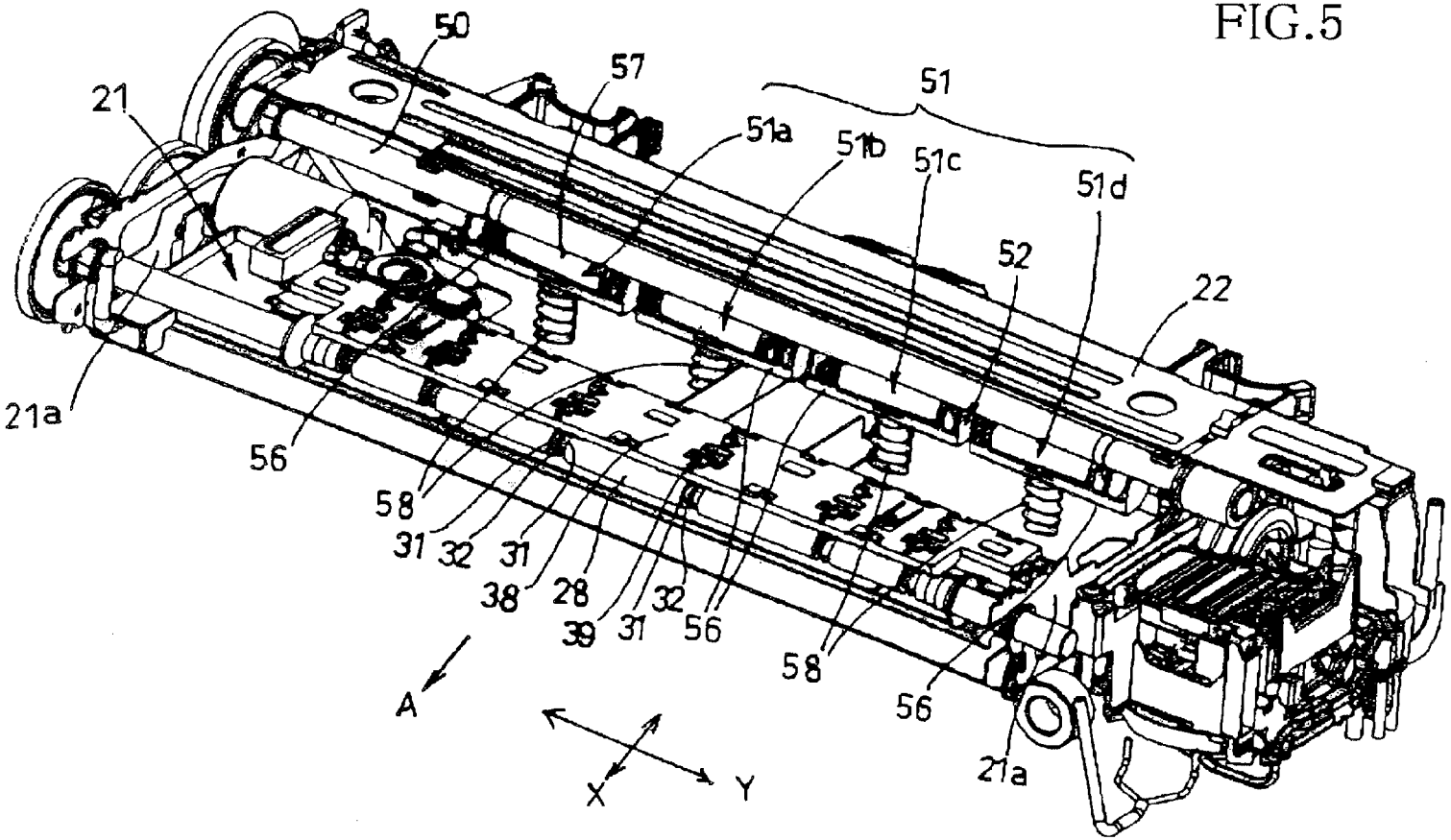
FIG. 5 is a perspective view of the apparatus of FIG. 1 from which a carriage is removed.

On an upstream side of the platen 26 as viewed in the sheet feeding direction A, there are disposed, as registering rollers for feeding the sheet P to the underside of the recording head 4, a sheet supplying roller 50 and nip rollers 51*a*-51*d* which are disposed below the sheet supplying roller 50 so as to face the same 50, as shown in FIGS. 4 and 5. On a downstream side of the platen 26 as viewed in the sheet feeding direction A, there are disposed a sheet discharging roller 28 as a drive roller that is driven by a drive source (not shown) to feed the sheet P which has passed through the recording portion 7 in the sheet feeding direction A toward a sheet exist portion 10, and a plurality of toothed wheel unit 30 as driven rollers which are disposed above the sheet discharging roller 28 so as to face the same 28 and which are biased toward the sheet discharging roller 28 (see FIGS. 4 and 6). It is noted that a total of six toothed wheel unit 30 are provided in this embodiment.

The sheet P on which the recording operation by the recording portion 7 has been performed is discharged into the sheet exist portion 10, with the recorded surface of the sheet P facing upwardly. The sheet exist portion 10 is located above the sheet-supply cassette 3, and a sheet exist opening 10*a* communicating with the sheet exist portion 10 is open on the front side of the housing 2 so as to be in common with the front opening 2*a* of the housing 2. Further, a partition plate (lower covering member) 29 made of a synthetic resin and formed integrally with the housing 2 is provided to extend from a lower surface of the second guide member 23 to the front end of the housing 2 where the sheet exist opening 10*a* is open, so as to cover the sheet exist portion 10 on its upper side, as shown in FIG. 2.

Next, there will be described in detail a sheet holding structure by a cooperative action of the sheet discharging roller 28 and the toothed wheel units 30 for holding the sheet P therebetween, according to a first embodiment.

Figure 6:
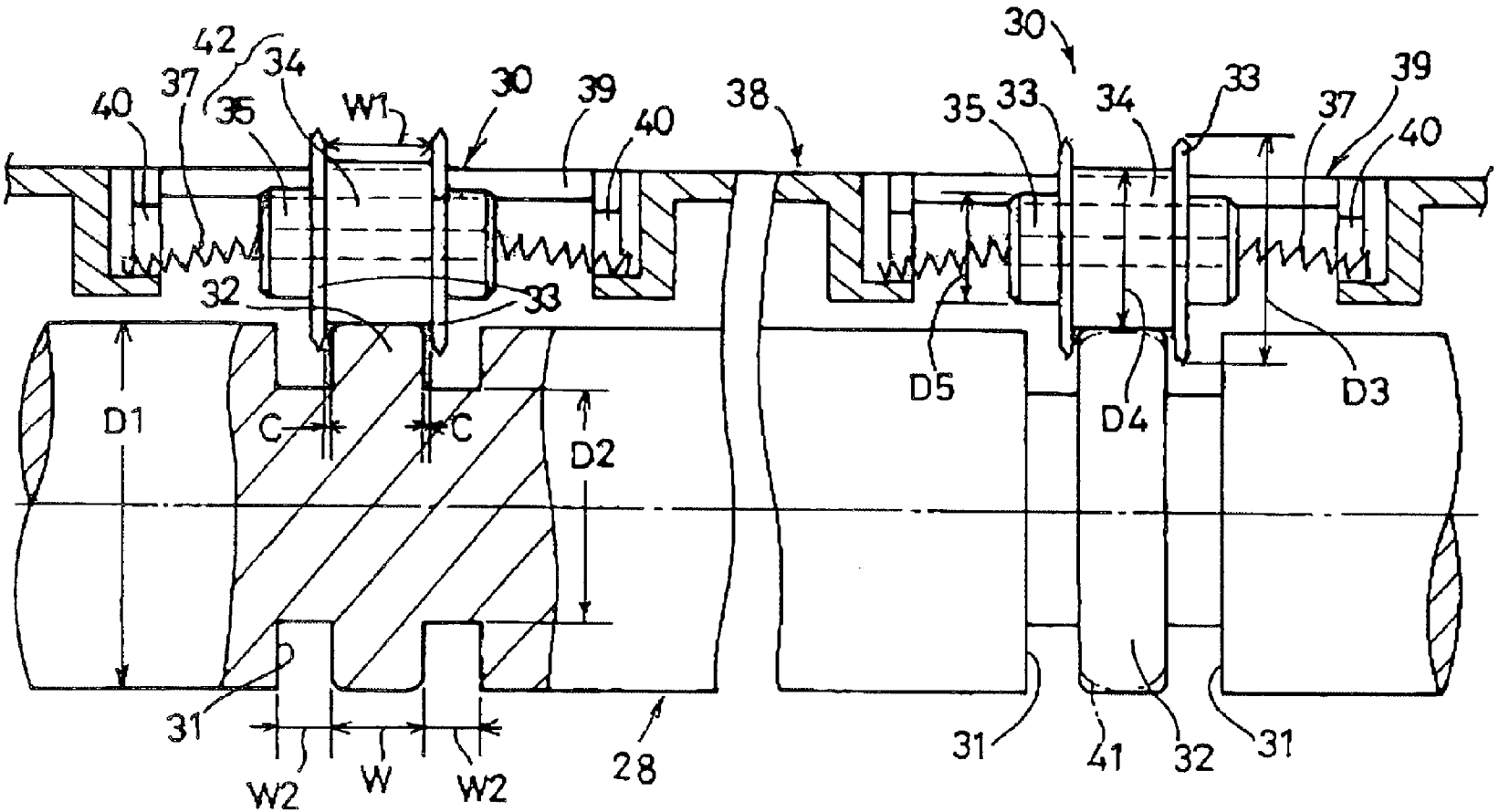
FIG. 6 is a fragmentary front elevational view partly in cross section showing a sheet discharging roller and a toothed wheel unit according to a first embodiment of the invention.

As shown in FIGS. 5 and 6, the sheet discharging roller 28 has a cylindrical shape having a diameter D1 and extending in the direction (the Y-axis direction or the widthwise direction of the sheet P) perpendicular to the sheet feeding direction A. The sheet discharging roller 28 is supported at its opposite axial end portions by the respective side plates 21*a* of the main frame 21 and is rotated by a drive force transmitted from the drive force. The sheet discharging roller 28 is made of a metal, and has an outer circumferential surface that is adapted to generate an increased friction force. For example, the outer circumferential surface of the sheet discharging roller 28 may be knurled, coated with ceramic particles by bonding, or fixedly covered with a rubber or other thin resin film having a high degree of coefficient of friction. The sheet discharging roller 28 includes several pairs of annularly grooved portions 31 and non-grooved portions 32 each of which is interposed between a corresponding one of the pairs of annularly grooved portions 31. The several pairs of annularly grooved portions 31 are spaced apart from each other by a predetermined distance in the widthwise direction of the sheet P. Each of the annularly grooved portions 31 has a diameter D2 smaller than the diameter D1 of each of the non-grooved portions 32 (D2<D1), so that a radially outer end of each annularly grooved portion 31 is closer to an axis of the roller 28 than a radially outer end of each non-groove portion 32. In the present embodiment, each pair of the annularly grooved portions 31 serves as a first portion of the roller 28 while each non-grooved portion 32 serves as a second portion of the roller 28. It is further noted each annularly grooved portion 31 does not necessarily have to have, in its cross section perpendicular to the axis of the roller 28, a circular shape, but may have a polygonal or other shape. In this case, too, the distance of the radially outer end of the annularly grooved portion 31 from the axis of the roller 28 corresponds to a half of the above-described D2.

As shown in FIG. 6, each toothed wheel unit 30 is disposed to be opposed to a portion of the sheet discharging roller 28 in its axial direction corresponding to each pair of annularly grooved portions 31 and the non-grooved portion 32 located between the pair of grooved portions 31. The toothed wheel unit 30 as the drive roller includes a toothed wheel portion that is provided by a pair of rowels 33 each having a diameter D3, and a non-toothed portion 42 connecting the two rowels 33 and formed of a synthetic resin. The non-toothed portion 42 includes: a cylindrical intermediate hub portion 34 which has a diameter D4 and which connects inner axial end faces of the respective two rowels 33 at radially inner portions thereof and two cylindrical outside hub portions 35 which have a diameter D5 and each of which is connected to a radially inner portion of an outer axial end face of the corresponding one of the two rowel 33. In this first embodiment in which the intermediate hub portion 34 serves as a contactable portion, the diameter D4 of the intermediate hub portion 34 is larger than the diameter D5 of the outside hub portions 35, is smaller than the diameter D3 of the rowels 33 (D3>D4>D5).

Figure 7:
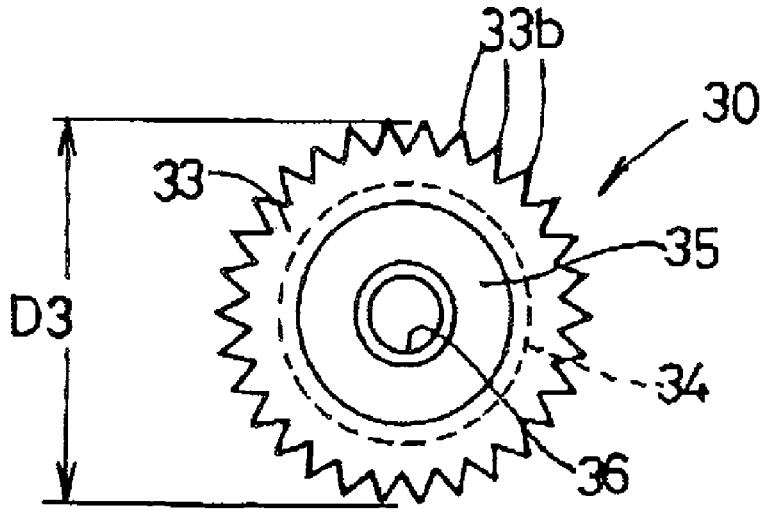
FIG. 7 is a side elevational view of the toothed wheel unit.

As shown in FIG. 7, each rowel 33 is a disc-like member made of metal and has a multiplicity of projections 33*b* formed at its radially outer end continuously along its circumference. Each projection 33*b* has a generally triangular shape in side view with a sharp or acute tip. A through-hole 36 is formed through respective centers of the intermediate hub portion 34, outside hub portions 35 and two rowels 33 of each toothed wheel unit 30 so as to extend in the axial direction of the toothed wheel unit 30. An elastic shaft 37 serving as a biaser and made of a coil spring is inserted through the through-hole 36. According to this arrangement, each toothed wheel unit 30 is made rotatable about the corresponding elastic shaft 37 and displaceable in a direction intersecting its rotation axis by deflection of the elastic shaft 37.

A support plate 38 made of a synthetic resin and fixed at its opposite ends to the respective side plates 21*a* of the main frame 21 is disposed above the sheet discharging roller 28 so as to be parallel with the same 28, as shown in FIGS. 5 and 6. The support plate 38 is formed with mounting holes 39 into which the plurality of toothed wheel units 30 are respectively received. At opposite ends of each mounting hole 39 as seen in the axial direction of the toothed wheel unit 30, there are provided support portions 40 which respectively support axially opposite ends of the elastic shaft 37 so as to prevent the elastic shaft 37 from being displaced in the upward direction.

Each of the axially opposite end portions of the elastic shaft 37 is distant from the axis of the sheet discharging roller 28 by a distance that is smaller than a sum of a radius (D4/2) of the intermediate hub portion 34 of the toothed wheel unit 30 and a radius (D1/2) of the non-grooved portion 32 of the sheet discharging roller 28, so that the elastic shaft 37 is elastically bent by contact of the intermediate hub portion 34 of the toothed wheel unit 30 with the non-grooved portion 32 of the sheet discharging roller 28, so as to bias the toothed wheel unit 30 toward the sheet discharging roller 28.

In a state in which the sheet P is not held or gripped by and between the sheet discharging roller 28 and the toothed wheel units 30, each of the elastic shafts 37 which are provided for the respective toothed wheel units 30 is supported at its opposite end portions by the support portions 40 such that the corresponding toothed wheel unit 30 is biased toward the sheet discharging roller 28 by the elastic shaft 37, as shown in FIG. 6. In this instance, the pair of rowels 33 in each toothed wheel unit 30 are respectively received in the corresponding pair of annularly grooved portions 31 of the sheet discharging roller 28, and the intermediate hub portion 34 of the toothed wheel unit 30 is held in contact at its circumferential surface, with the corresponding non-grooved portion 32 of the sheet discharging roller 28. Thus, the sheet discharging roller 28 is biased by the toothed wheel unit 30. In other words, the non-grooved portion 32 is interposed between the two rowels 33 so as to face the intermediate hub portion 34. In this arrangement, however, each rowel 33 is arranged not to be brought into contact, at its radially outer end (the projections 33), on the circumferential surface of the corresponding annularly grooved portion 31. To this end, in this embodiment, the non-grooved portion 32 located between the pair of rowels 33 has a width W as measured in its axial direction which is smaller than a width W1 of the intermediate hub portion 34 as measured in its axial direction while each annularly grooved portion 31 has a width W2 which is about ten times as large as a thickness t1 of each rowel 33, thereby forming a clearance C between each of axial end faces of the non-grooved portion 32 and a corresponding one of axial inner end faces of the respective two rowels 33 confronting the each axial end face of the non-grooved portion 32 (see FIG. 6). In this embodiment, the diameter D3 of and the thickness t1 of each rowel 33 is about 6 mm and about 0.1 mm, respectively. The diameter D4 of the intermediate hub portion 34 is about 4 mm, the diameter D1 of the sheet discharging roller 28 is about 8.1 mm, and the diameter D2 of the annularly grooved portion 31 is about 5.5 mm. The width W2 of the annularly grooved portion 31 is about 1.2 mm, the width W (=W1−2C) of the non-grooved portion 32 is not larger than 2 mm, and the clearance C is not larger than 1 mm.

In the arrangement described above, when the sheet P is not held by and between the sheet discharging roller 28 and the toothed wheel units 30 which are biased toward the roller 28, the rowels 33 of each toothed wheel unit 30 are out of contact, at their radially outer ends, with any portion of the sheet discharging roller 28 to which the toothed wheel unit 30 is opposed. Therefore, the radially outermost sharp projections 33*b* of the rowel 33 are less likely to be worn. More specifically described, the sharp projections 33*b* are prevented from being deformed, due to wear resulting from contact with the bottom surface of the annularly grooved portion 31 of the sheet discharging roller 28, into a somewhat rounded shape which tends to form impression onto the recording surface of the sheet P and to cause transfer of the ink adhering thereto back to the recorded surface of the sheet P. Further, the circumferential surface of the intermediate hub portion 34 of each toothed wheel unit 30 abuts on the circumferential surface of the corresponding non-grooved portion 32 of the sheet discharging roller 28, whereby the toothed wheel unit 30 is lifted up or raised. Accordingly, when the sheet P is not held by and between the sheet discharging roller 28 and the toothed wheel units 30, it is possible to reduce an amount of introduction of each rowel 33 into the corresponding annularly grooved portion 31, namely, an overlap amount by which the radially outer end of each rowel 33 overlaps with the non-grooved portion 32. Owing to the reduction in the overlap amount, a work (i.e., force times distance) required to raise the toothed wheel unit 30 upon entrance of the leading end of the sheet P between the sheet discharging roller 28 and the toothed wheel unit 30 can be reduced, thereby assuring smooth feeding of the sheet P. Therefore, the line feed pitch is not varied, so that the occurrence of the banding upon entrance of the leading end of the sheet P between the roller 28 and the unit 30 can be avoided. Because the intermediate hub portion 34 of each toothed wheel unit 30 is held in contact with the corresponding non-grooved portion 32 of the sheet discharging roller 28, the toothed wheel unit 30 is rotated by rotation of the sheet discharging roller 28. Accordingly, the resistance against entrance of the sheet P between the roller 28 and the unit 30 is reduced, whereby the sheet P can be smoothly moved in the sheet feeding direction.

In the image recording apparatus 1 constructed as described above, in response to a command requesting an image recording, the uppermost sheet P of the stack accommodated in the sheet supply cassette 3 is advanced by rotation of the sheet separate roller 6*b* so as to come into contact, at its leading end, with the slant sheet separator plate 8, so that the sheet P is separated from the stack and then moved toward the sheet supply path 9. The sheet P makes a U-turn upwardly along the sheet supply path 9 and is moved onto the platen 26 of the image recording portion 7 with its leading end held by and between the sheet supplying roller 50 and the nip rollers 51.

Figure 8:
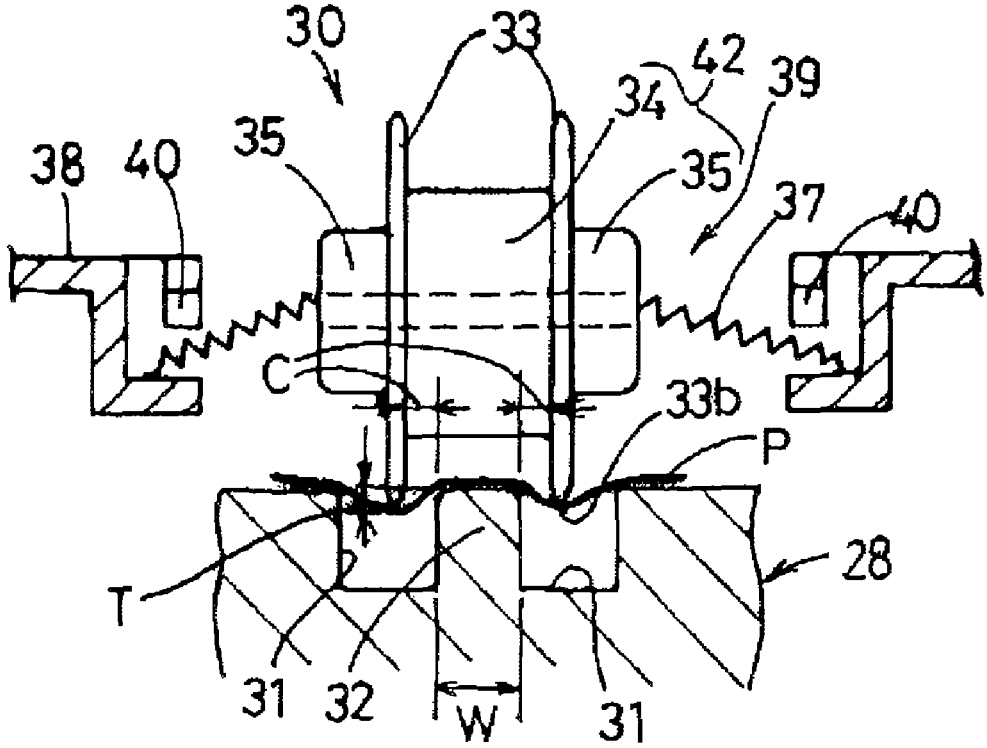
FIG. 8 is a view explaining a state in which a sheet P is held by and between the sheet discharging roller and the toothed wheel unit.

In a state in which the sheet P (on which an image has been recorded as a result of passing through the image recording portion 7) is being fed (discharged) between the sheet discharging roller 28 and the plurality of toothed wheel units 30 while being held therebetween, each toothed wheel unit 30 is lifted up by a resistance force of the sheet P to deflection or flexure, i.e., by resilience of the sheet P, against the biasing force of the elastic shaft 37, as shown in FIG. 8. In this state, the sheet P is deflected or flexed into an upwardly convex curved shape between the radially outer ends (the projections 33*b*) of the respective two rowels 33 of each toothed wheel unit 30 by the non-grooved portion 32 while the sheet P is deflected or flexed into a downwardly convex curved shape at portions thereof corresponding to the annularly grooved portions 31 by the radially outer ends (the projections 33*b*) of the respective two rowels 33 of each toothed wheel unit 30. Thus, there is generated, in the sheet P, tension (a reaction force against the deflection), so that the sheet P can be fed in the sheet feeding direction with a suitable feeding force.

Figure 10:
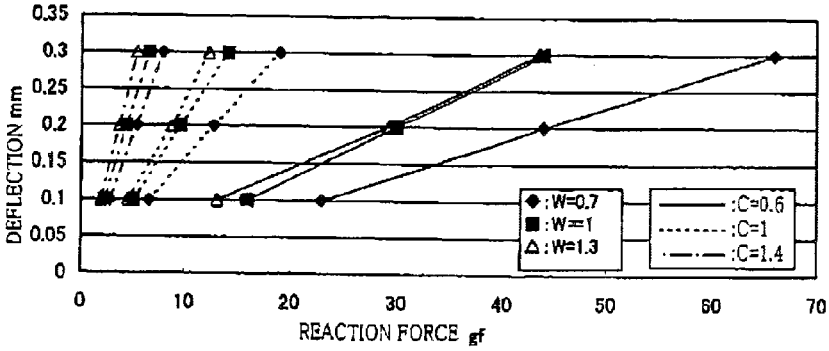
FIG. 10 is a graph showing experimental data in which the abscissa represents reaction force and the ordinate represents deflection amount, using parameters in the form of width W of a non-grooved portion of the sheet discharging roller and clearance C between each of axial end faces of the non-grooved portion and an axial inner end faces of a corresponding one of two rowels of the toothed wheel unit.

An amount T (mm) of deflection of the sheet P (shown in FIG. 8), that is, an amount by which the sheet P is deflected into each annularly grooved portion 31 by the biasing force of the elastic shaft 37 was measured by varying the width W of the non-grooved portion 32 and the clearance C between each of the axial end faces of the non-grooved portion 32 and each of the axial inner end faces of the respective two rowels 33. The deflection amount T of the sheet P may be considered as a distance measured from a contact point of the sheet P and the radially outer end (the projections 33*b*) of each rowel 33 to a contact point of the sheet P and the circumferential surface of the non-grooved portion 32. In the measurement, the used sheets P had the same paper quality, and images were recorded on the sheets P at the same recording density. The results of measurement are indicated in the table of FIG. 9. Based on the measured deflection amount T (mm), the reaction force (gf: gram force) acting on each one rowel 33 was calculated according to a suitable formula (representative of a relationship between deflection of a beam simply supported at its opposite ends and support reaction force where concentrated load acts on two intermediate points of the beam). FIG. 10 is a graph in which the abscissa represents the reaction force and the ordinate represents the deflection amount, using the width W and the clearance C as parameters.

Figure 11:
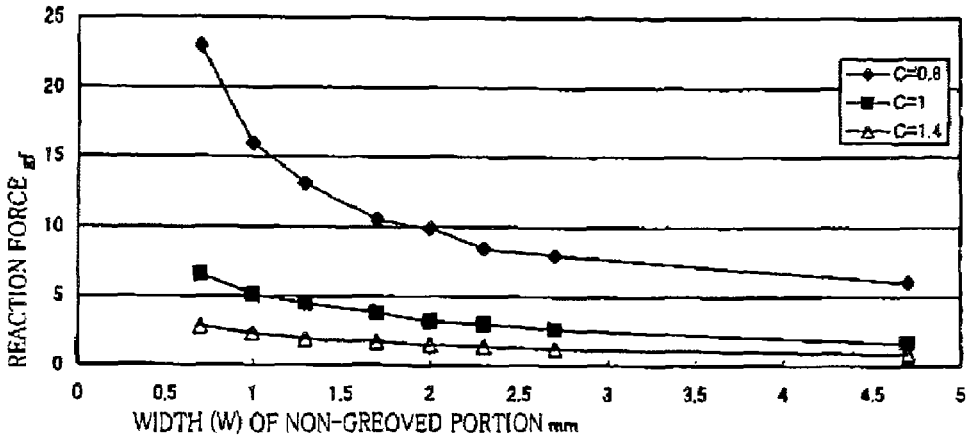
FIG. 11 is a graph showing experimental data in which the abscissa represents the width W and the ordinate represents the reaction force, using the clearance C as a parameter.
Figure 12:
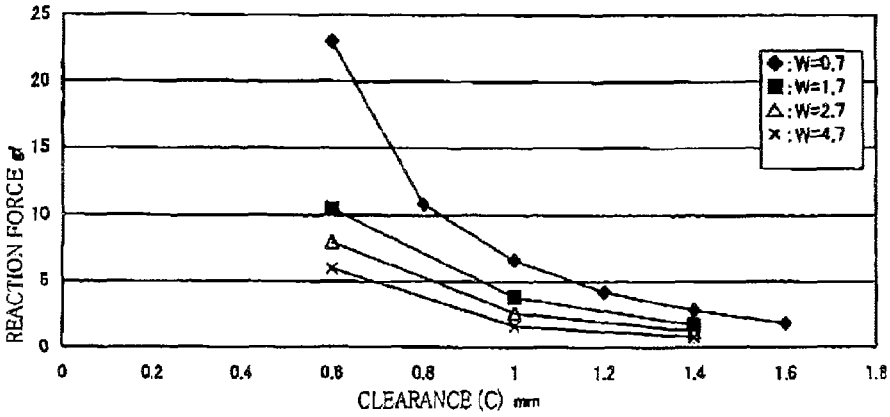
FIG. 12 is a graph showing experimental data in which the abscissa represents the clearance C and the ordinate represents the reaction force, using the width W as a parameter.

FIG. 11 is a graph in which the abscissa represents the width W of the non-grooved portion 32 and the ordinate represents the reaction force, using the clearance C as a parameter. FIG. 12 is a graph in which the abscissa represents the clearance C and the ordinate represents the reaction force, using the width W as a parameter.

As is apparent from the experimental results, where the clearance C is large, the reaction force is not largely changed and is small irrespective of variation in the width W of the non-grooved portion 32. Where the clearance C is small (i.e., not larger than about 1 mm), on the other hand, the reaction force is increased with a reduction in the width W. In other words, by reducing the width W of the non-grooved portion 32, a relatively large reaction force, namely, a relatively large feeding force can be obtained where the clearance C is small. Further, where the width W of the non-grooved portion 32 is larger than 2.5 mm, the reaction force is small and remains on the small level.

From the experimental results indicated above, the following is recognized: In the arrangement described above, the intermediate hub portion 34 having a smaller diameter than the pair of rowels 33 is interposed between the rowels 33 of each toothed wheel unit 30, and the sheet discharging roller 28 has the non-grooved portion 32 formed between the annularly grooved portions 31 into which the radially outer portions of the respective rowels 33 of each toothed wheel unit 30 are receivable. In this arrangement, by setting the above-indicated clearance C to not larger than 1 mm or setting the width W of the non-grooved portion 32 to not larger than 2 mm, the following advantage is assured: If the sheet P to be used is an ordinary paper sheet, the sheet P may get wet due to the ink attached thereto upon recording of images with high dot density such as photograph images, whereby the sheet P may suffer from low resiliency, namely, a low resistance force to the deflection. In the present arrangement, however, even if the sheet P suffers from such low resiliency, the feeding force for feeding the sheet P while being held by and between the sheet discharging roller 28 and each toothed wheel unit 30 is not lowered, so that the sheet P can be fed with high reliability. Therefore, it is possible to avoid the occurrence of the problematic banding.

Figure 13:
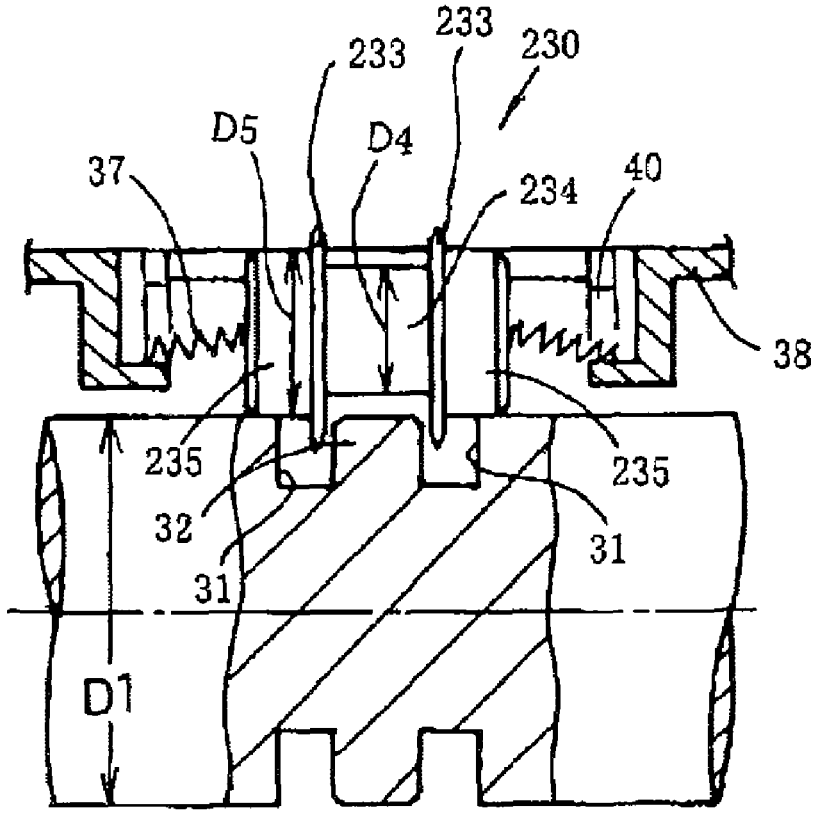
FIG. 13 is a fragmentary front elevational view partly in cross section showing a sheet discharging roller and a toothed wheel unit according to a second embodiment.

Referring next to FIG. 13, there will be described a sheet holding structure according to a second embodiment of the invention. As in the first embodiment, the radially outer end of each rowel 233 is out of contact with the sheet discharging roller 28 when the sheet P is not held by and between the sheet discharging roller 28 and the toothed wheel units 230 as the drive and driven rollers. In this second embodiment, the diameter D5 of each of the outside hub portions 235 which are respectively provided axially outwardly of the two rowels 233 of each toothed wheel unit 230 is made larger than the diameter D4 of the intermediate hub portion 234. In this arrangement, therefore, when the sheet P is not held between the sheet discharging roller 28 and the toothed wheel units 230, the circumferential surfaces of the outside hub portions 235 of each toothed wheel unit 230 are respectively held in contact with circumferential surfaces of respective two portions of the sheet discharging roller 28 which are located axially outwardly of the corresponding two annularly grooved portions 31 of the sheet discharging roller 28 and which have the diameter D1, while the circumferential surface of the intermediate hub portion 34 is out of contact with the circumferential surface of the non-grooved portion 32, namely, the intermediate hub portion 34 is radially spaced apart from the non-grooved portion 32 by a suitable spacing. This second embodiment differs from the above-described first embodiment only in the construction of each toothed wheel unit 230, and its detailed explanation is dispensed with by using the same reference numerals as in the first embodiment to identify the corresponding components. As in the first embodiment, the radially outer end of each rowel 233 does not contact the inner surface of the corresponding annularly grooved portion 31, whereby the sharp projections at the radially outer end of the rowel 233 do not suffer from wear. Accordingly, it is possible to prevent formation of the impression on the recording surface of the sheet P due to the worn projections and avoid deterioration of the image quality due to the transfer of the ink adhering to the worn projections back to the recording surface of the sheet P, as discussed above in the description of the first embodiment. Further, the amount of introduction of the radially outer portion of each rowel 233 into the corresponding annularly grooved portion 31 (i.e., the overlap amount) can be reduced, as in the first embodiment. Owing to the reduction in the overlap amount, the work required for raising the toothed wheel unit 230 upon entering of the leading end of the sheet P between the sheet discharging roller 28 and the toothed wheel unit 230 can be reduced, thereby assuring smooth feeding of the sheet P. It is therefore possible to avoid the variation in the line feed pitch, so that the occurrence of the banding can be prevented. Because the two outside hub portions 235 in each toothed wheel unit 230 are respectively held in contact with the above-described two portions of the sheet discharging roller 28, the toothed wheel unit 230 is rotated by rotation of the sheet discharging roller 28. Accordingly, the resistance acting on the sheet P entering between the sheet discharging roller 28 and the toothed wheel unit 230 is reduced, whereby the sheet P can be smoothly moved.

Referring back to FIG. 6, the non-grooved portion 32 has chamfered corner portions at each of which the circumferential surface and each of the axial end faces of the non-grooved portion 32 are connected. The circumferential surface of the non-grooved portion 32 may be formed into a curved surface 41 (may be referred to as "crown"), which is convexed outwardly in the radial direction so that its diameter is larger in its axially intermediate portion than in its axial end portions, as indicated in two-dot chain line in FIG. 6. Where the circumferential surface of the non-grooved portion 32 is formed as indicated in the two-dot chain, the sheet P is free of a risk of suffering from creasing which could arise from folding of the sheet P at the corner portions of the non-grooved portion 32 when the sheet P held by and between the two rowels 33 of each toothed wheel unit 30 and the circumferential surface of the non-grooved portion 32 is fed therebetween. Therefore, the image quality is not deteriorated.

While the circumferential surface of the intermediate hub portion 34, 234 in each toothed wheel unit 30, 230 is provided by a straight cylindrical surface in the above-described first and second embodiments, the circumferential surface may be configured to include a pair of inclined surfaces as in third through sixth embodiments (FIGS. 14-16) that are described below. It is noted that the same reference numerals as used in the first embodiment are used to identify the corresponding components and a detailed explanation thereof is not provided.

Figure 14:
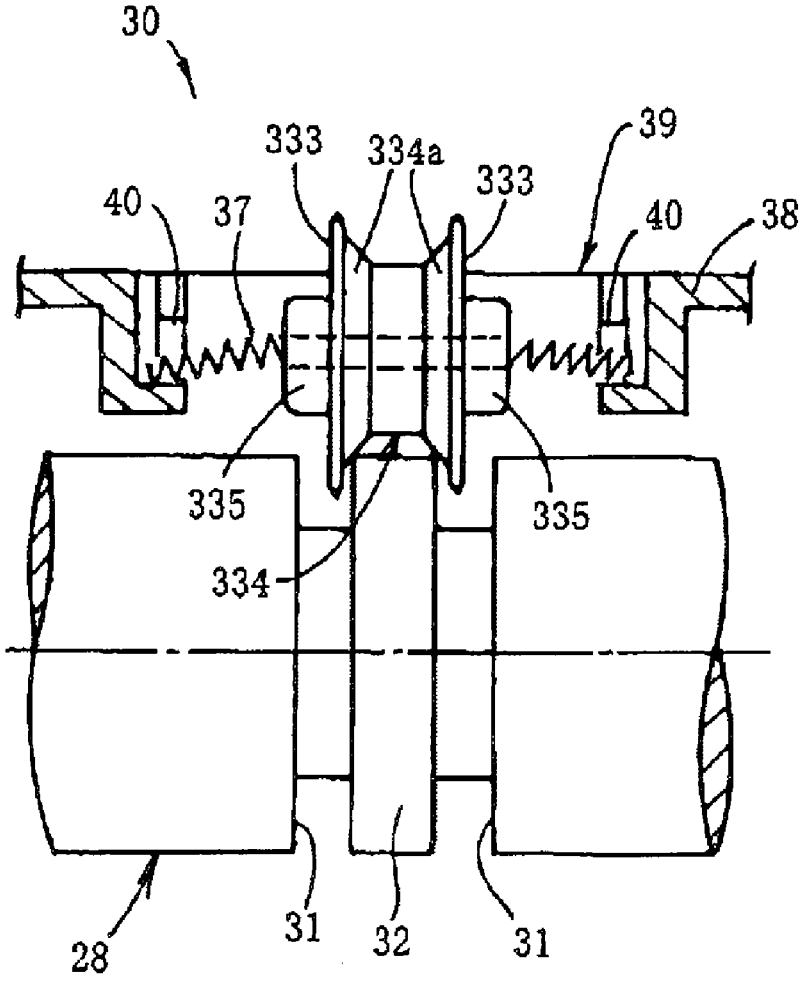
FIG. 14 is a fragmentary front elevational view partly in cross section showing a sheet discharging roller and a toothed wheel unit according to a third embodiment.

In the third embodiment shown in FIG. 14, the driven roller is provided by a toothed wheel unit 330 including two rowels 333, an intermediate hub portion 334 and two outside hub portions 335. The intermediate hub portion 334 is formed to have a globoid-like configuration in which the diameter of the circumferential surface is gradually reduced as viewed in a direction away from each of the axially opposite ends of the intermediate hub portion 334 toward the axially intermediate portion thereof. Thus, the intermediate hub portion 334 has the pair of inclined surfaces in the form of a pair of tapered surfaces 334*a*. In this third embodiment, an annular protrusion is defined by the non-grooved portion 32 of the sheet discharging roller 28, while an annular recess (in which the annular protrusion is received during absence of the sheet P between the sheet discharging roller 28 and the toothed wheel unit 330) is defined by the intermediate hub portion 334 of the toothed wheel unit 330. The tapered surfaces 334*a* are inclined, with respect to the axis of the roller 28, in respective opposite directions by substantially the same degree, such that the tapered surfaces 334*a* cooperate with each other to generally have a radially convexed shape that is convexed in a direction away from the annular protrusion toward the annular recess.

Figure 15:
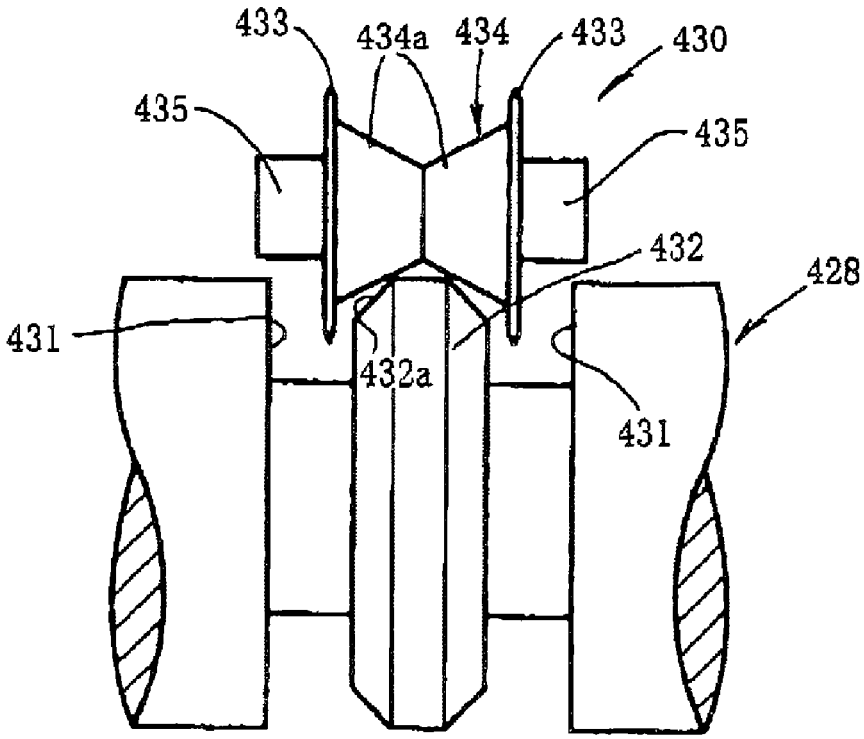
FIG. 15 is a fragmentary front elevational view showing a sheet discharging roller and a toothed wheel unit according to a fourth embodiment.

In the fourth embodiment shown in FIG. 15, the driven roller is provided by a toothed wheel unit 430 including two rowels 433, an intermediate hub portion 434 and two outside hub portions 435, while the drive roller is provided by a sheet discharging roller 428 including several pairs of annularly grooved portions 431 and a non-grooved portions 432 that is located between each adjacent pair of the annularly grooved portions 431. The intermediate hub portion 434 has a configuration in which two truncated cones are connected to each other. The circumferential surface of the intermediate hub portion 434 is given by a combination of circumferential surfaces of the respective two truncated cones, and has a diameter which is lineally reduced as viewed in a direction away from each of the axially opposite ends of the intermediate hub portion 434 toward the axially intermediate portion thereof. Thus, the intermediate hub portion 434 has the pair of inclined surfaces in the form of a pair of tapered surfaces 434*a*. In this fourth embodiment, the annular protrusion is defined by the non-grooved portion 432 of the sheet discharging roller 428, while the annular recess is defined by the intermediate hub portion 434 of the toothed wheel unit 430.

Figure 16A:
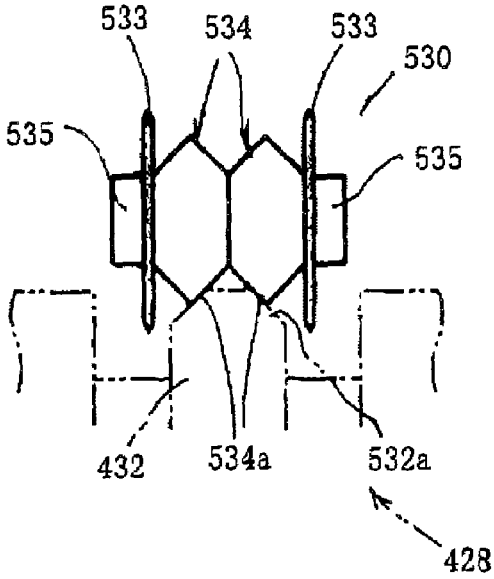
FIG. 16A is a front elevational view showing a toothed wheel unit according to a fifth embodiment.

In the fifth embodiment shown in FIG. 16A, the driven roller is provided by a toothed wheel unit 530 including two rowels 533, an intermediate hub portion 534 and two outside hub portions 535. The intermediate hub portion 534 has a configuration in which four truncated cones are connected to each other, so that the intermediate hub portion 534 has the pair of inclined surfaces in the form of a pair of tapered surfaces 534*a* located in its axially middle portion. In this fifth embodiment, the annular protrusion is defined by the non-grooved portion 432 of the sheet discharging roller 428, while the annular recess is defined by the intermediate hub portion 534 of the toothed wheel unit 530.

Figure 16B:
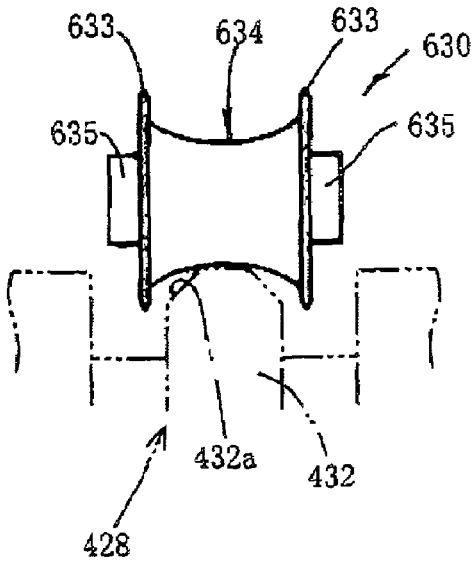
FIG. 16B is a front elevational view showing a toothed wheel unit according to a sixth embodiment.

In the sixth embodiment shown in FIG. 16B, the driven roller is provided by a toothed wheel unit 630 including two rowels 633, an intermediate hub portion 634 and two outside hub portions 635. The intermediate hub portion 634 is formed to have a globoid-like configuration in which the diameter is gradually reduced in a curved manner rather than in a linear manner, as viewed in a direction away from each of the axially opposite ends of the intermediate hub portion 534 toward the axially intermediate portion thereof. Thus, the intermediate hub portion 634 has the pair of inclined surfaces in the form of a curved circumferential surface. In this sixth embodiment, the annular protrusion is defined by the non-grooved portion 432 of the sheet discharging roller 428, while the annular recess is defined by the intermediate hub portion 634 of the toothed wheel unit 630.

As is clear from the above descriptions, the pair of inclined surfaces may be provided by either straight or curved surfaces. It is further noted that, in the above-descried fourth through sixth embodiments, the non-grooved portion 432 of the sheet discharging roller 428 has chamfered corners 432*a* which are formed by chamfering the corners by about 45 degrees and at each of which the circumferential surface and each of the axial end faces of the non-grooved portion 432 are connected. However, as described above with reference to FIG. 6, the non-grooved portion 432 may have rounded corners, or its circumferential surface may be formed to convexed outwardly in the radial direction. Like the rounded corners and the radially outwardly convexed surface, the chamfered corners 432*a* are effective to prevent the creasing of the sheet P.

Figure 17:
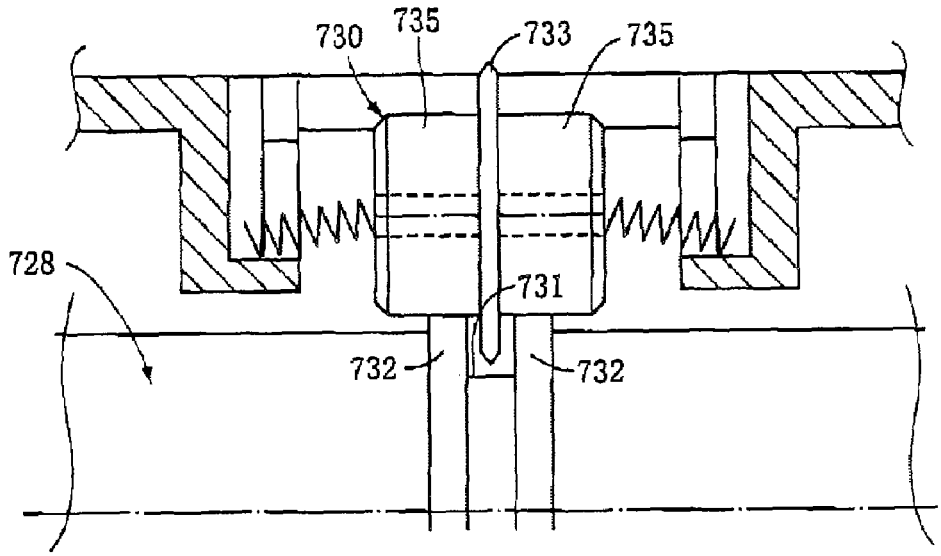
FIG. 17 is a fragmentary front elevational view partly in cross section showing a sheet discharging roller and a toothed wheel unit according to a seventh embodiment.

FIG. 17 shows a sheet holding structure according to a seventh embodiment of the invention in which the driven roller is provided by a toothed wheel unit 730 including a single rowel 733 and two outside hub portions 735, while the drive roller is provided by a sheet discharging roller 728 including several pairs of non-grooved portions 732 and an annularly grooved portion 731 that is located between each adjacent pair of the non-grooved portions 732. In this embodiment, the outside hub portions 735 of the toothed wheel unit 730 serve as the contactable portion, while the non-grooved portions 732 of the sheet discharging roller 728 serve as the second portion. Thus, the outside hub portions 735 are held in contact with the non-grooved portions 732, during absence of the sheet between the toothed wheel unit 730 and the sheet discharging roller 728. The rowel 733 is distant from each of the non-grooved portions 732 by 1 mm or less as measured in the axial direction. Each of the non-grooved portions 732 has a length of 2 mm or less as measured in the axial direction.

Figure 18:
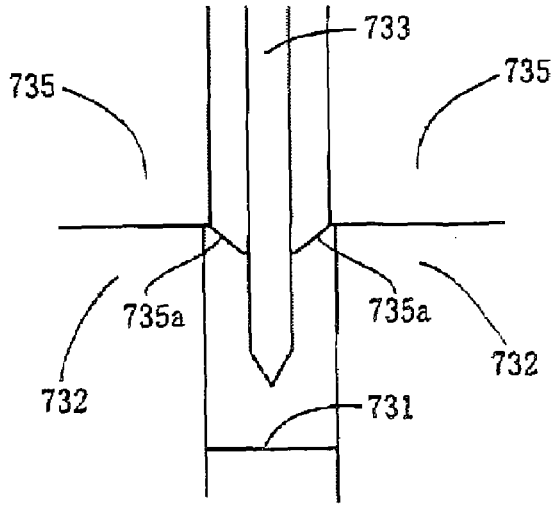
FIG. 18 is a fragmentary front elevational view showing a toothed wheel unit according to a modification of a seventh embodiment.

FIG. 18 shows a modification of the above-described seventh embodiment in which each of the outside hub portions 735 has a tapered surface 735*a* in its adjacent portion that is adjacent to the rowel 733. Thus, the tapered surfaces 735*a* of the respective outside hub portions 735 cooperate with each other to constitute the above-described pair of inclined surfaces. In this modification, the annular protrusion is defined by the rowel 733 and the adjacent portion 735*a* of each of the outside hub portions 735, while the annular recess is defined by the annularly grooved portion 731.

Figure 19:
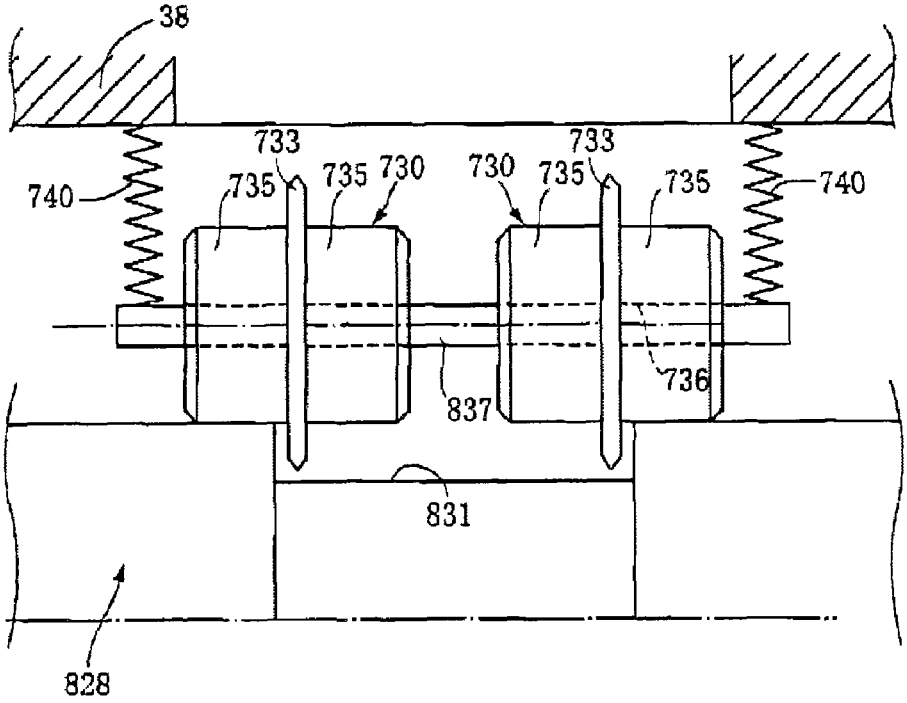
FIG. 19 is a fragmentary front elevational view partly in cross section showing a sheet discharging roller and a pair of toothed wheel units according to an eight embodiment.

FIG. 19 shows a sheet holding structure according to an eighth embodiment of the invention in which the driven roller is provided by a pair of toothed wheel units 730, while the drive roller is provided by a sheet discharging roller 828 including an annularly grooved portion 831. In this embodiment, a shaft 837 made of a rigid material is provided to extend through axial through-holes 736 of the toothed wheel units 730, such that the toothed wheel units 730 are rotatably mounted on the shaft 837. Further, in this embodiment, the biaser is provided by a pair of elastic members in the form of coil springs 740 each of which is connected at one of its opposite end portions to the support plate 38 and at the other end portion to a corresponding one of axial end portions of the shaft 837, so that the toothed wheel units 730 are biased toward the sheet discharging roller 828. As shown in FIG. 19, one of the outside hub portions 735 of each toothed wheel unit 730 serves as the contactable portion, while the non-grooved portions of the sheet discharging roller 828 serve as the second portion.

According to the above-described third through sixth embodiments and the above-descried modification of the seventh embodiments (see FIGS. 14, 15, 16A, 16B and 18), when the trailing end of the sheet P comes out of the sheet discharging roller (28; 428; 728) and the toothed wheel units (330; 430; 530; 630; 730) and then the one or two rowels (333; 433; 533; 633; 733) of each toothed wheel unit (330; 430; 530; 630; 730) (which have been raised by the sheet P) enter the corresponding one or two annularly grooved portions (31; 431; 731), the corners of the non-grooved portion (32; 432; 732) are brought into contact with the respective inclined surfaces (334*a*; 434*a*; 534*a*; 634; 735*a*) of the intermediate or outside hub portion (334; 434; 534; 634; 735), which are arranged substantially symmetrically with respect to a center of each of the annular protrusion and recess in the axial direction. Therefore, the above-described clearance C can be held in its suitable amount with high reliability, thereby preventing chipping of the radially outermost projections of each rowel (333; 433; 533; 633; 733) due to its collision with the circumferential surface of the non-grooved portion (32; 432; 732). Further, because the amount of the clearance C can be made equal on axially opposite sides of the non-grooved portion (32; 432; 732), namely, the two clearances C between the axial end faces of the non-grooved portion (32; 432; 732) and the corresponding axially end faces of the rowel or rowels (333; 433; 533; 633; 733) can be made equal to each other, the feeding force required for feeding the sheet P can be stabilized in the widthwise direction of the sheet P, preventing the sheet P from being moved obliquely with respect to the sheet feeding direction. Moreover, the relative position of the sheet discharging roller (28; 428; 728) and each toothed wheel unit (330; 430; 530; 630; 730) in the axial direction is restricted by contact of the inclined surfaces (334*a*; 434*a*; 534*a*; 634; 735*a*) and the non-grooved portion (32; 432; 732), even where any other means for restricting the relative position is not provided.

While the preferred embodiments of this invention have been described in detail by reference to the drawings, it is to be understood that the invention may be otherwise embodied.

For example, in the sheet discharging roller (28; 428) of the above-described first and third through sixth embodiments, each of the annularly grooved portions (31; 431) serving as the first portion (that is to receive the toothed wheel portion therein without its contact with the toothed wheel portion) may be have a width (axial length) larger than as indicated in the above descriptions. In the sheet discharging roller (28;

828) of the above-described second and eighth embodiments, there may be provided small diameter portions which are located in axially opposite sides of the second portion (that is to be held in contact with the contactable portion), as in the sheet discharging roller (728) of the seventh embodiment.

What is claimed is:

1. A feeding device for feeding a sheet in a feeding direction, comprising:

a drive roller that is configured to be driven by a drive source; and a driven roller that is opposed to said drive roller in a radial direction thereof and is biased toward said drive roller, such that said driven roller and said drive roller cooperate with each other to feed the sheet while holding the sheet therebetween, wherein said driven roller includes a toothed wheel portion and a contactable portion having a diameter smaller than that of said toothed wheel portion, wherein said drive roller includes a first portion and a second portion, such that a radially outer end of said second portion is more distant from an axis of said drive roller than a radially outer end of said first portion, wherein said drive and driven rollers are positioned relative to each other during absence of the sheet therebetween, such that said contactable portion of said driven roller is held in contact at a circumferential surface thereof with a circumferential surface of said second portion of said drive roller, and such that a radially outer end of said toothed wheel portion is not in contact with a circumferential surface of said first portion, and wherein said first portion of said drive roller is provided by at least one annularly grooved portion of an outer circumferential surface of said drive roller while said second portion of said drive roller is provided by at least one non-grooved portion of said outer circumferential surface of said drive roller, such that said toothed wheel portion is received at least at a peripheral portion thereof in said at least one annularly grooved portion.

2. The feeding device according to claim 1, further comprising a biaser biasing said driven roller toward said drive roller.

3. The feeding device according to claim 2, further comprising a shaft extending through an axial through-hole of said driven roller such that said driven roller is rotatably mounted on said shaft, wherein said biaser includes an elastic member biasing said shaft toward said drive roller so as to bias said driven roller toward said drive roller.

4. The feeding device according to claim 2, wherein said drive roller has one of an annular protrusion and an annular recess, while said driven roller has the other of said annular protrusion and said annular recess, such that at least a part of said annular protrusion is received in said annular recess during absence of the sheet between said drive and driven rollers, wherein said drive and driven rollers have a pair of inclined surfaces each of which is provided by at least a part of one of circumferential surfaces of the respective annular protrusion and recess, and wherein said inclined surfaces are inclined with respect to said axis of said drive roller, in respective opposite directions by substantially the same degree, such that said inclined surfaces cooperate with each other to generate forces which are based on a biasing force generated by said biaser and which act in said driven roller in respective directions parallel to said axis of said drive roller.

5. The feeding device according to claim 4, wherein said inclined surfaces are arranged substantially symmetrically with respect to a center of each of said annular protrusion and recess in an axial direction of said driven roller.

6. The feeding device according to claim 4, wherein said toothed wheel portion of said driven roller is provided by two rowels that are spaced apart from each other in an axial direction of said driven roller, while said contactable portion of said driven roller is provided by an intermediate hub portion that is located between said two rowels in said axial direction of said driven roller, wherein said first portion of said drive roller is provided by two annularly grooved portions that are spaced apart from each other in the axial direction of said drive roller, while said second portion of said drive roller is provided by a non-grooved portion that is located between said two annularly grooved portions in said axial direction of said drive roller, such that each of said two rowels is received at least at a peripheral portion thereof in a corresponding one of said two annularly grooved portions during absence of the sheet between said drive and driven rollers, and such that said intermediate hub portion is held in contact with said non-grooved portion during absence of the sheet between said drive and driven rollers, and wherein said annular protrusion is defined by each of said non-grooved portion located between said two annularly grooved portions, while said annular recess is defined by said intermediate hub portion located between said two rowels.

7. The feeding device according to claim 4, wherein said contactable portion of said driven roller is provided by two outside hub portions that are spaced apart from each other in an axial direction of said driven roller, while said toothed wheel portion of said driven roller is provided by at least one rowel that is located between said two outside hub portions in said axial direction of said driven roller, and wherein said second portion of said drive roller is provided by two non-grooved portions that are spaced apart from each other in the axial direction of said drive roller, while said first portion of said drive roller is provided by an annularly grooved portion that is located between said two non-grooved portions, such that each of said at least one rowel is received at least at a peripheral portion thereof in said annularly grooved portion during absence of the sheet between said drive and driven rollers, and such that said two outside hub portions are held in contact with said two non-grooved portions during absence of the sheet between said drive and driven rollers, wherein said annular protrusion is defined by said at least one rowel that is located between said two outside hub portions, and an adjacent portion of each of said two outside hub portions that is adjacent to said at least one rowel, and wherein said annular recess is defined by said annularly grooved portion that is located between said two non-grooved portions.

8. The feeding device according to claim 1, wherein said toothed wheel portion of said driven roller is arranged substantially symmetrically with respect to a center of said driven roller in an axial direction of said driven roller, and wherein said contactable portion of said driven roller is arranged substantially symmetrically with respect to said center of said driven roller in said axial direction of said driven roller.

9. The feeding device according to claim 1, wherein said contactable portion of said driven roller is provided by two outside hub portions that are spaced apart from each other in an axial direction of said driven roller, while said toothed wheel portion of said driven roller is provided by at least one rowel that is located between said two outside hub portions in said axial direction of said driven roller, and wherein said second portion of said drive roller is provided by two non-grooved portions that are spaced apart from each other in the axial direction of said drive roller, while said first portion of said drive roller is provided by an annularly grooved portion that is located between said two non-grooved portions, such that each of said at least one rowel is received at least at a peripheral portion thereof in said annularly grooved portion during absence of the sheet between said drive and driven rollers, and such that said two outside hub portions are held in contact with said two non-grooved portions during absence of the sheet between said drive and driven rollers.

10. The feeding device according to claim 9, wherein said drive roller has an intermediate annular protrusion which is located in a center of said annularly grooved portion in the axial direction of said drive roller and which has substantially the same diameter as that of each of said two non-grooved portions, wherein said at least one rowel received in said annularly grooved portion consists of two rowels that are located in opposite sides of said intermediate annular protrusion, and wherein each of said two rowels is distant from said intermediate annular protrusion by 1 mm or less as measured in the axial direction of said drive roller.

11. The feeding device according to claim 9, wherein said at least one rowel received in said annularly grooved portion consists of a single rowel that is distant from each of said two non-grooved portions by 1 mm or less as measured in the axial direction of said drive roller.

12. The feeding device according to claim 9, wherein said drive roller has an intermediate annular protrusion which is located in a center of said annularly grooved portion in the axial direction of said drive roller and which has substantially the same diameter as that of each of said two non-grooved portions, and wherein said intermediate annular protrusion has a length of 2 mm or less as measured in the axial direction of said drive roller.

13. The feeding device according to claim 9, wherein each of said non-grooved portions has a length of 2 mm or less as measured in the axial direction of said drive roller.

14. The feeding device according to claim 1, wherein said circumferential surface of said second portion of said drive roller is provided by a curved surface that is convexed outwardly in the radial direction of said drive roller.

15. The feeding device according to claim 1, wherein said second portion has (i) an axial end surface that connects said circumferential surface of said second portion and said circumferential surface of said first portion, and (ii) a chamfered corner at which said circumferential surface and said axial end surface of said second portion intersect each other.

16. The feeding device according to claim 1, wherein said second portion has (i) an axial end surface that connects said circumferential surface of said second portion and said circumferential surface of said first portion, and (ii) a rounded corner at which said circumferential surface and said axial end surface of said second portion intersect each other.

17. An image recording apparatus comprising:

the feeding device defined in claim 1; and an image recording unit which is operable to record an image on the sheet, wherein said feeding device is disposed on a downstream side of said image recording unit as viewed in said feeding direction, so as to feed the sheet having the image recorded thereon.

18. A feeding device for feeding a sheet in a feeding direction, comprising:

a drive roller that is configured to be driven by a drive source:

a driven roller that is opposed to said drive roller in a radial direction thereof and is biased toward said drive roller, such that said driven roller and said drive roller cooperate with each other to feed the sheet while holding the sheet therebetween; and a biaser biasing said driven roller toward said drive roller, wherein said driven roller includes a toothed wheel portion and a contactable portion having a diameter smaller than that of said toothed wheel portion, wherein said drive roller includes a first portion and a second portion, such that a radially outer end of said second portion is more distant from an axis of said drive roller than a radially outer end of said first portion, wherein said drive and driven rollers are positioned relative to each other during absence of the sheet therebetween, such that said contactable portion of said driven roller is held in contact at a circumferential surface thereof with a circumferential surface of said second portion of said drive roller, and such that a radially outer end of said toothed wheel portion is not in contact with a circumferential surface of said first portion, wherein said radially outer end of said toothed wheel portion of said driven roller is closer to said axis of said drive roller than said radially outer end of said second portion of said drive roller in a radial direction of said drive roller, wherein said toothed wheel portion of said driven roller is close to said second portion of said drive roller in an axial direction of said drive roller such that a distance between said toothed wheel portion and said second portion in the axial direction is less than or equal to 1 mm, wherein said biaser includes an elastic shaft which extends through an axial through-hole of said driven roller such that said driven roller is rotatably mounted on said elastic shaft, wherein said elastic shaft is held at axially opposite end portions thereof by a support member of said feeding device, and wherein each of said axially opposite end portions of said elastic shaft is distant from an axis of said drive roller by a distance that is smaller than a sum of a radius of said contactable portion of said driven roller and a radius of said second portion of said drive roller, so that said elastic shaft is elastically bent by said contact of said contactable portion of said driven roller with said second portion of said drive roller, so as to bias said driven roller toward said drive roller.

19. A feeding device for feeding a sheet in a feeding direction, comprising:

a drive roller that is configured to be driven by a drive source;

a driven roller that is opposed to said drive roller in a radial direction thereof and is biased toward said drive roller, such that said driven roller and said drive roller cooperate with each other to feed the sheet while holding the sheet therebetween; and a biaser biasing said driven roller toward said drive roller, wherein said driven roller includes a toothed wheel portion and a contactable portion having a diameter smaller than that of said toothed wheel portion, wherein said drive roller includes a first portion and a second portion, such that a radially outer end of said second portion is more distant from an axis of said drive roller than a radially outer end of said first portion, wherein said drive and driven rollers are positioned relative to each other during absence of the sheet therebetween, such that said contactable portion of said driven roller is held in contact at a circumferential surface thereof with a circumferential surface of said second portion of said drive roller, and such that a radially outer end of said toothed wheel portion is not in contact with a circumferential surface of said first portion, wherein said radially outer end of said toothed wheel portion of said driven roller is closer to said axis of said drive roller than said radially outer end of said second portion of said drive roller in a radial direction of said drive roller, wherein said toothed wheel portion of said driven roller is close to said second portion of said drive roller in an axial direction of said drive roller such that a distance between said toothed wheel portion and said second portion in the axial direction is less than or equal to 1 mm, wherein said toothed wheel portion of said driven roller is provided by two rowels that are spaced apart from each other in an axial direction of said driven roller, while said contactable portion of said driven roller is provided by an intermediate hub portion that is located between said two rowels in said axial direction of said driven roller, and wherein said first portion of said drive roller is provided by two annularly grooved portions that are spaced apart from each other in the axial direction of said drive roller, while said second portion of said drive roller is provided by a non-grooved portion that is located between said two annularly grooved portions in said axial direction of said drive roller, such that each of said two rowels is received at least at a peripheral portion thereof in a corresponding one of said two annularly grooved portions during absence of the sheet between said drive and driven rollers, and such that said intermediate hub portion is held in contact with said non-grooved portion during absence of the sheet between said drive and driven rollers.

20. The feeding device according to claim 19, wherein each of said two rowels received in a corresponding one of said two annularly grooved portions is distant from said non-grooved portion by 1 mm or less as measured in the axial direction of said drive roller.

21. The feeding device according to claim 19, wherein said non-grooved portion has a length of 2 mm or less as measured in the axial direction of said drive roller.

* * * * *